US009921019B2

(12) United States Patent
Stone

(10) Patent No.: US 9,921,019 B2
(45) **Date of Patent: *Mar. 20, 2018**

(54) GAS VENT FOR FIREARM

(71) Applicant: RA Brands, L.L.C., Madison, NC (US)

(72) Inventor: Jeffrey W. Stone, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/165,589

(22) Filed: May 26, 2016

(65) Prior Publication Data

US 2016/0313081 A1 Oct. 27, 2016

Related U.S. Application Data

(63) Continuation of application No. 14/543,242, filed on Nov. 17, 2014, now Pat. No. 9,383,154.

(60) Provisional application No. 61/915,229, filed on Dec. 12, 2013.

(51) Int. Cl.
*F41A 21/28* (2006.01)
*F41A 21/48* (2006.01)

(52) U.S. Cl.
CPC ..... *F41A 21/28* (2013.01); *F41A 21/481* (2013.01)

(58) Field of Classification Search
CPC .. F41A 1/06; F41A 21/00; F41A 21/28; F41A 19/03; F41A 21/481
USPC ..... 42/76.01, 77
See application file for complete search history.

(56) References Cited

U.S. PATENT DOCUMENTS

| | | | |
|---|---|---|---|
| 529,455 | A | 11/1894 | Marlin |
| 1,864,374 | A | 6/1932 | Herman Schuler |
| 2,637,247 | A | 5/1953 | Hester |
| 2,655,837 | A | 10/1953 | Johnson |
| 2,887,013 | A | 5/1959 | Marsh |
| 2,918,847 | A | 12/1959 | Barr |
| 2,981,154 | A | 4/1961 | Sweeney |
| 3,163,952 | A | 1/1965 | Into |
| 3,306,168 | A | 2/1967 | Blumrick |
| 3,486,411 | A | 12/1969 | Lichenstern |
| 3,538,810 | A | 11/1970 | Mallard |
| 3,568,564 | A | 3/1971 | Badali |

(Continued)

FOREIGN PATENT DOCUMENTS

| | | |
|---|---|---|
| DE | 12114 | 1/1881 |
| DE | 4107675 | 9/1992 |

(Continued)

OTHER PUBLICATIONS

A New Level of Surgical Precision—Modular Sniper Rifle (MSR)—Remington Military Products Division www.remingtonmilitary.com: @ The Freedom Group, 2009.

*Primary Examiner* — Joshua E Freeman
(74) *Attorney, Agent, or Firm* — D. Scott Sudderth

(57) ABSTRACT

A barrel for a firearm including a chamber configured to receive a round of ammunition, and a shoulder at least partially extending from an exterior surface of the barrel. The barrel also has a gas vent feature formed in the exterior surface of the barrel to vent gases from the chamber. The gas vent feature may include at least one channel formed in the exterior surface of the barrel, and the at least one channel may have a predetermined depth and at least partially extend into the shoulder of the barrel.

21 Claims, 22 Drawing Sheets

(56) References Cited

U.S. PATENT DOCUMENTS 3,611,611 A 10/1971 Quinney
3,675,534 A 7/1972 Beretta
3,715,955 A 2/1973 Folley et al.
3,731,418 A 5/1973 Birkenhagen et al.
3,745,686 A 7/1973 Koon, Jr.
3,776,096 A 12/1973 Donovan
3,842,527 A 10/1974 Low
3,877,167 A 4/1975 Keepeler
4,126,077 A 11/1978 Quesnel
4,288,938 A 9/1981 Kahn
4,546,564 A 10/1985 Acosta
4,674,217 A 6/1987 Matievich
4,685,235 A 8/1987 Bunning et al.
4,709,617 A 12/1987 Anderson
4,765,224 A 8/1988 Morris
4,920,679 A 5/1990 Sarles et al.
4,930,238 A 6/1990 Poff
5,020,260 A 6/1991 Houghton
5,155,284 A 10/1992 Flashkes
5,272,956 A 12/1993 Hudson
5,351,598 A 10/1994 Schuetz
5,410,834 A 5/1995 Benton et al.
5,412,895 A 5/1995 Keieger
5,433,133 A 7/1995 La France
5,448,940 A 9/1995 Schuetz et al.
5,454,182 A 10/1995 Lewis et al.
5,479,737 A 1/1996 Osborne et al.
5,499,569 A 3/1996 Schuetz
5,520,019 A 5/1996 Schuetz
5,706,599 A 1/1998 Knight
5,726,377 A 3/1998 Harris et al.
5,737,865 A 4/1998 Brandl et al.
5,740,626 A 4/1998 Schuetz
5,798,474 A 8/1998 Rogers
5,826,361 A 10/1998 Jamison
5,827,992 A 10/1998 Harris et al.
5,831,202 A 11/1998 Rustick
5,834,678 A 11/1998 Kalb
5,907,919 A 6/1999 Keeney
5,937,563 A * 8/1999 Schuetz ..... F41A 21/10 42/106
5,987,797 A 11/1999 Dustin
6,044,748 A 4/2000 Westrom
6,182,389 B1 2/2001 Lewis
6,205,696 B1 3/2001 Bilgeri
6,250,198 B1 6/2001 Vendetti et al.
6,293,040 B1 9/2001 Luth
6,318,230 B1 11/2001 Bamber
6,470,616 B1 10/2002 Clay
6,564,691 B2 5/2003 Butler
6,574,898 B2 6/2003 Spencer et al.
6,604,314 B2 8/2003 Fluhr
6,606,812 B1 8/2003 Gwinn, Jr.
6,606,934 B1 8/2003 Rock et al.
6,609,323 B1 8/2003 Donnelly
6,619,592 B2 9/2003 Vignarili et al.
6,655,372 B1 12/2003 Field et al.
6,671,990 B1 1/2004 Booth
6,752,061 B2 6/2004 Knorich
6,959,509 B2 11/2005 Vais
6,971,202 B2 * 12/2005 Bender ..... F41A 5/24 42/16
7,076,904 B1 7/2006 Rustick
7,287,456 B2 10/2007 Spielberger
7,311,032 B2 12/2007 Murello
7,347,023 B2 3/2008 Wooser
7,451,564 B2 11/2008 Watt
7,467,581 B2 12/2008 Botty
7,523,580 B1 4/2009 Tankersley
7,574,823 B2 8/2009 Nakayama
7,694,619 B2 * 4/2010 Beretta ..... F41A 21/28 89/14.3
7,721,639 B2 5/2010 Woosner
7,775,150 B2 8/2010 Hochestrate et al.
7,810,272 B2 10/2010 Brixius
7,823,314 B1 11/2010 Wheatley
7,905,041 B1 3/2011 Davies
7,946,214 B2 5/2011 Stone
7,975,417 B2 7/2011 Duplessis et al.
8,087,194 B1 * 1/2012 Vuksanovich ..... F41A 21/48 42/75.01
8,109,194 B2 2/2012 Stone
8,240,074 B2 8/2012 Vuksanovich
8,250,964 B2 8/2012 Stone
8,429,844 B2 4/2013 Dextraze et al.
8,479,429 B2 * 7/2013 Barrett ..... F41A 3/26 42/75.02
8,490,312 B2 7/2013 Barrett et al.
8,505,227 B2 * 8/2013 Barrett ..... F41A 3/26 42/75.02
8,522,465 B2 9/2013 Jarboe et al.
8,539,708 B2 * 9/2013 Kenney ..... F41A 21/485 42/75.01
8,739,449 B2 * 6/2014 Patel ..... F41C 23/16 42/75.02
8,739,450 B2 * 6/2014 Piontek ..... F41A 21/10 42/77
8,931,118 B2 1/2015 Aalto
9,057,576 B2 * 6/2015 Barrett ..... F41A 21/481
2002/0073832 A1 3/2002 Vignaroli et al.
2004/0049964 A1 3/2004 Vais
2005/0115398 A1 6/2005 Olson
2005/0188590 A1 9/2005 Barber et al.
2005/0188591 A1 9/2005 Stone
2005/0223613 A1 10/2005 Bender
2005/0229463 A1 10/2005 Tashjian
2006/0283068 A1 12/2006 Beretta
2007/0033851 A1 2/2007 Hochstrate et al.
2007/0186458 A1 8/2007 Wait
2007/0193102 A1 8/2007 Briggs
2007/0199435 A1 8/2007 Hochstrate et al.
2008/0168695 A1 7/2008 Nakayama
2008/0276797 A1 11/2008 Leitner-Wise
2009/0013579 A1 1/2009 Fluhr
2009/0031607 A1 2/2009 Robinson et al.
2010/0005956 A1 1/2010 Wossner
2010/0122483 A1 5/2010 Clark
2010/0175290 A1 7/2010 Duplessis
2010/0269682 A1 10/2010 Vuksanovich
2010/0300277 A1 12/2010 Hochstrate et al.
2011/0016762 A1 1/2011 Davies
2012/0073177 A1 3/2012 Laney et al.
2012/0132068 A1 5/2012 Kucynko
2012/0137556 A1 6/2012 Laney et al.
2012/0216439 A1 8/2012 Barrett
2012/0311908 A1 12/2012 Kenney et al.
2013/0145669 A1 6/2013 Zonshine
2013/0291420 A1 11/2013 Aalto
2014/0115938 A1 5/2014 Jarobe
2014/0150638 A1 6/2014 Ricks
2014/0352188 A1 * 12/2014 Widder ..... F42B 5/184 42/14
2015/0168092 A1 * 6/2015 Stone ..... F41A 21/28 42/76.01

FOREIGN PATENT DOCUMENTS

DE 4136665 5/1993
EP 1215464 6/2002
ES 2304040 9/2008
GB 214505 4/1924
GB 506632 6/1939
WO WO 2009/061546 5/2009
WO WO 2010/151549 12/2010

* cited by examiner

GAS VENT FOR FIREARM

CROSS REFERENCE TO RELATED APPLICATIONS

The present Patent Application is a continuation of previously filed, co-pending U.S. patent application Ser. No. 14/543,242, filed Nov. 17, 2014, which is a formalization of previously filed U.S. Provisional Patent Application Ser. No. 61/915,229, filed Dec. 12, 2013, by the inventor named in the present Application. This Patent Application claims the benefit of the filing date of these cited Applications according to the statutes and rules governing provisional patent applications, particularly 35 U.S.C. § 119(a)(i) and 37 C.F.R. § 1.78(a)(4)-(5). The specification and drawings of the Patent Applications referenced above are specifically incorporated herein by reference as if set forth in their entireties.

TECHNICAL FIELD

Embodiments of the disclosure are directed generally to gas operated firearms and, more particularly, to an apparatus for venting gases from a chamber of a firearm.

BACKGROUND

Semi-automatic firearms are designed to fire a round of ammunition, such as a cartridge or shot shell, in response to each squeeze of the trigger of the firearm, and thereafter automatically load the next shell or cartridge from the firearm magazine into the chamber of the firearm. During firing, the propellant inside the round is ignited, producing an expanding column of high pressure gases within the chamber and barrel of the firearm. The force of this expanding gas propels the bullet/shot of the round of ammunition down the barrel.

In some types of semi-automatic firearms, including rifles, shotguns, and some handguns, a portion of the expanding gases will be directed through a duct or port that interconnects the barrel of the firearm to a gas operating system, such as a piston assembly that houses an axially moveable gas piston, or a gas impingement system that redirects a portion of the expanding gases to impinge on the bolt assembly within a receiver of the firearm. The barrel and the gas operating system typically are coupled to the receiver of the firearm, with the gas operating system acting to cause the rearward motion of the bolt assembly, which in turn opens the chamber and causes the empty shell or cartridge casing to be ejected and thereafter, as the bolt assembly moves forwardly, a next round is loaded into the chamber, after which the bolt is returned to a locked position for firing as the expanding gases dissipate or are bled off.

In addition, during firing it is possible for a cartridge or round of ammunition in the firearm chamber to fail. Given the high pressures generated upon firing, especially when using higher power cartridges, such failures can cause gas pressure to build up in the chamber and/or the upper receiver. Such gases generally will be hot and under substantially high pressure, and thus can force unburned propellant, combustion residue, metal pieces and other debris from the failed cartridge, and/or other hazardous materials, out of the firearm in unpredictable trajectories. Consequently, it is desirable to protect a user from such high pressure gases venting from the firearm in the case of a cartridge failure.

Accordingly, it can be seen that a need exists for gas venting features for a firearm chamber that addresses the foregoing and other related and unrelated problems in the art.

SUMMARY

Briefly described, in one embodiment of the invention, a gas vent feature is provided for use with a gas-operated firearm. The firearm generally will include a barrel having a chamber at a proximal end thereof and a muzzle at its distal end, with an internal bore defined through the barrel from the chamber to the muzzle thereof. A barrel extension can be threadedly engaged with the proximal end of the barrel and can be received in a forward end of a receiver of the firearm. In one embodiment, the barrel and/or the barrel extension can include lugs for engaging a bolt that translates within the receiver. The barrel and/or the barrel extension can be coupled to the forward end of the receiver by a barrel nut that is threadedly engaged with the forward end of the receiver to clamp a collar extending from the barrel extension between a shoulder of the barrel nut and a forward face of the receiver.

In one embodiment, the gas vent feature can comprise one or more channels, slots, recesses or other, similar features formed in an exterior surface of the barrel, adjacent the proximal end of the barrel, to enable high pressure gases to be vented in a direction away from the shooter. In an additional embodiment, channels can be formed along an interior surface of the barrel extension. The one or more channels generally can extend longitudinally along the barrel, including being formed/extending through the threads formed adjacent the proximal end of the barrel and/or within the interior of the barrel extension. Accordingly, when the barrel and the barrel extension are threadedly engaged with the receiver, a nearly sealed volume is created at the chamber, while enabling excess gases in the chamber to be vented and travel from the barrel along the one or more channels between the threadedly engaged barrel and barrel extension, and away from the forward end of the receiver. The vented gases thus are directed away from a user of the firearm, towards the muzzle end of the barrel.

These and various other advantages, features, and aspects of the exemplary embodiments will become apparent and more readily appreciated from the following detailed description of the embodiments taken in conjunction with the accompanying drawings, as follows.

Figure 1A:
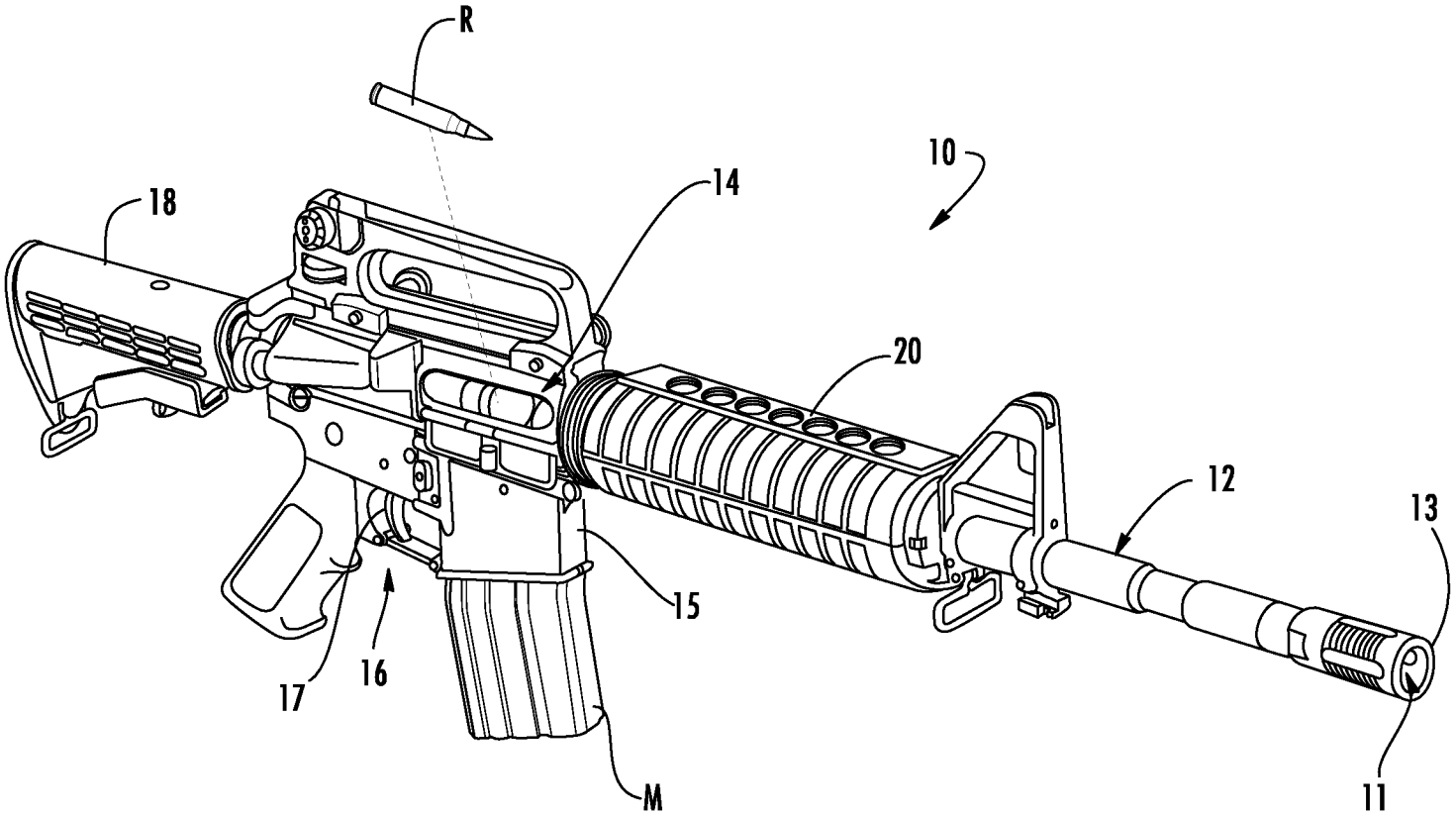
FIG. 1A is an isometric view of a firearm.

The embodiments of the invention and the various features thereof are explained below in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

DETAILED DESCRIPTION

Referring now to the drawings in which like numerals indicate like parts throughout the several views, the figures illustrate one example embodiment of the barrel mounting and retention apparatus or system according to the principles of the present disclosure for use in a firearm such as an M4, M16, AR-15, SCAR, AK-47, HK416, ACR, or other, similar type gas operated firearm. However, it will be understood that the principles of the barrel mounting and retention device of the present invention can be used in various types of firearms including shotguns, rifles and other long guns, handguns, and other firearms. The following description is provided as an enabling teaching of exemplary embodiments; and those skilled in the relevant art will recognize that many changes can be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances, and are a part of the invention. Thus, the following description is provided as illustrative of the principles of the embodiments and not in limitation thereof, since the scope of the invention is defined by the claims.

Figure 1B:
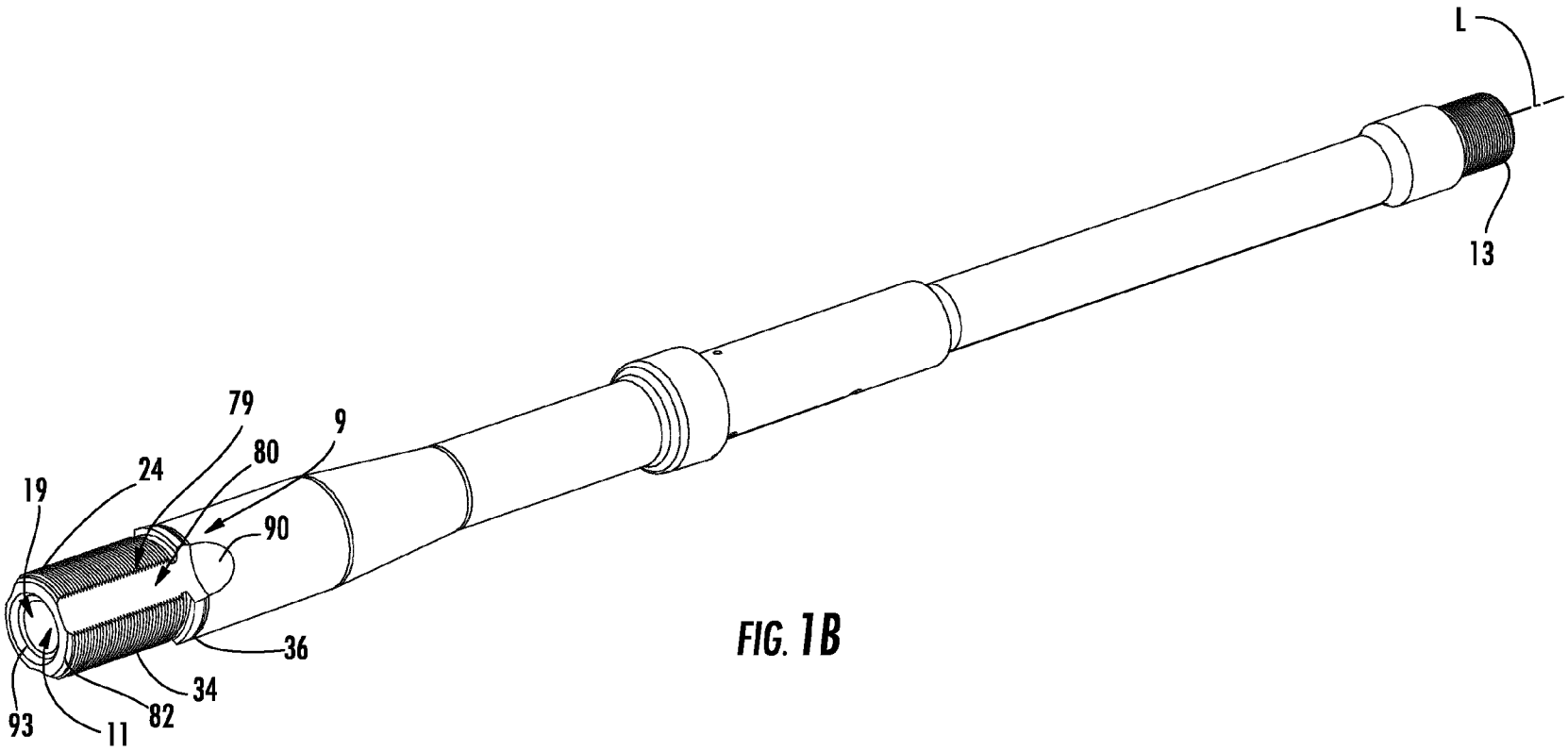
FIG. 1B is a perspective view of the barrel of a firearm including high pressure gas vents according to a first embodiment of the disclosure.

FIG. 1A illustrates a gas-operated firearm 10 having a gas operating system with a barrel mounting and retention device or system 8 (FIGS. 1C, 1D, 4A, and 4B) with a gas vent feature 9 (FIGS. 1B-2D) in one exemplary embodiment. The firearm 10 generally is shown as a rifle and includes a barrel 12 with a central bore 11 defined along a longitudinal axis L and terminating at a muzzle or distal end 13 (FIGS. 1B-1D), an upper receiver 14 (FIG. 1A), lower receiver or chassis 15 including a fire control 16, a stock 18, and a gas operating system (not shown). Further, a hand guard assembly 20 can be affixed to and/or utilized with the firearm 10, it being understood that various other types of hand guards also can be affixed to and/or utilized with the firearm 10, or a hand guard can be omitted from the firearm. For example, the firearm can incorporate a monolithic, integral upper-style receiver and hand guard, wherein the hand guard is integrally formed with the receiver, or an AR-style two-piece receiver and hand guard. A stock 18, also known as the buttstock or shoulder stock, may be formed in any conventional manner to include cushioning, special curvatures, grips, in a holding stock portion, etc.

Figure 1C:
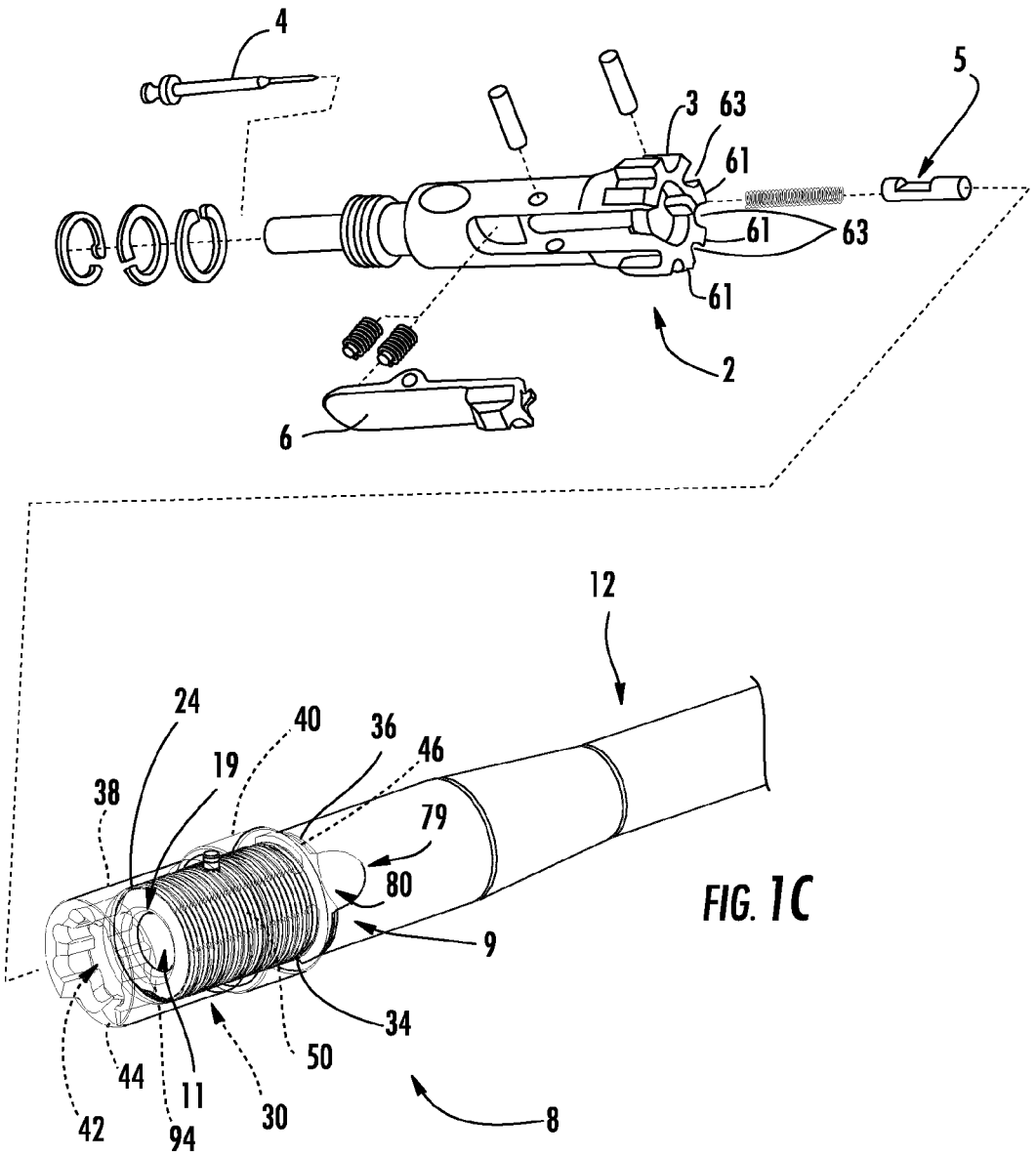
FIG. 1C is a perspective view of a barrel mounting apparatus including high pressure gas vents according to the first embodiment of the disclosure.

The firing mechanism or fire control 16 of the firearm generally includes a trigger 17 for actuating the firearm, a breech bolt or bolt assembly 2 with a bolt 3, a firing pin 4, an ejector 5 biased by an ejector spring, and an extractor 6 (schematically shown in FIG. 1C). In one embodiment, the ejector 5 and the extractor 6 can be coupled to the bolt 3 by respective pins. The bolt assembly 2 is translatable axially in both forward and rearward directions along the upper receiver 14 during the firing cycle and generally is located behind and communicates with a chamber portion 19 (FIG. 7) of the barrel 12, which is located at a proximal end 24 of the barrel 12 adjacent or at least partially received within the upper receiver 14. The chamber 19 receives a round of ammunition R, such as a shell or cartridge for firing, typically from a magazine M (FIG. 1A) received within the lower receiver 15.

Figure 1D:
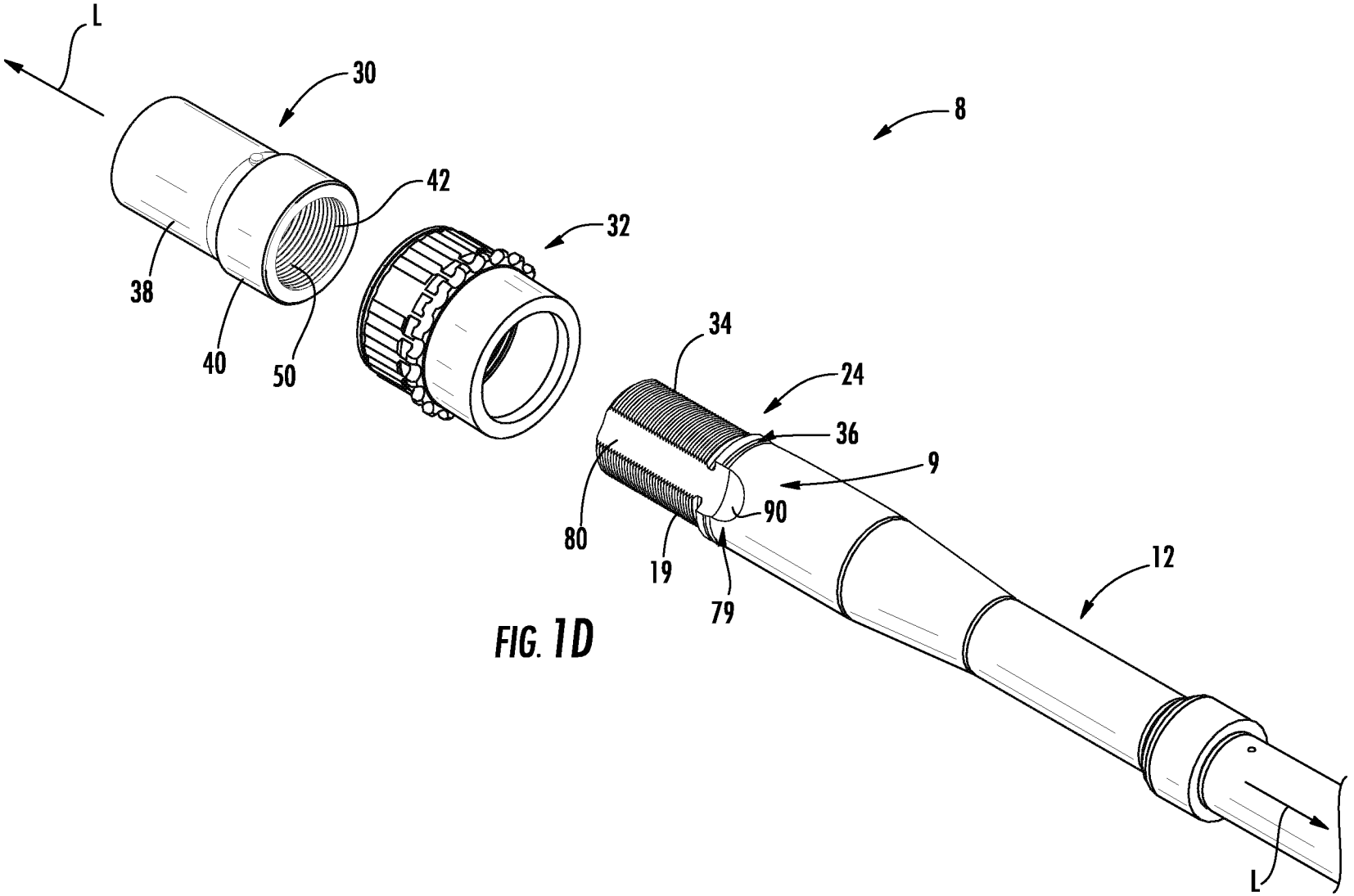
FIG. 1D is an isometric exploded view of a barrel, a barrel extension, and a barrel nut according to the first embodiment of the disclosure.
Figure 2A:
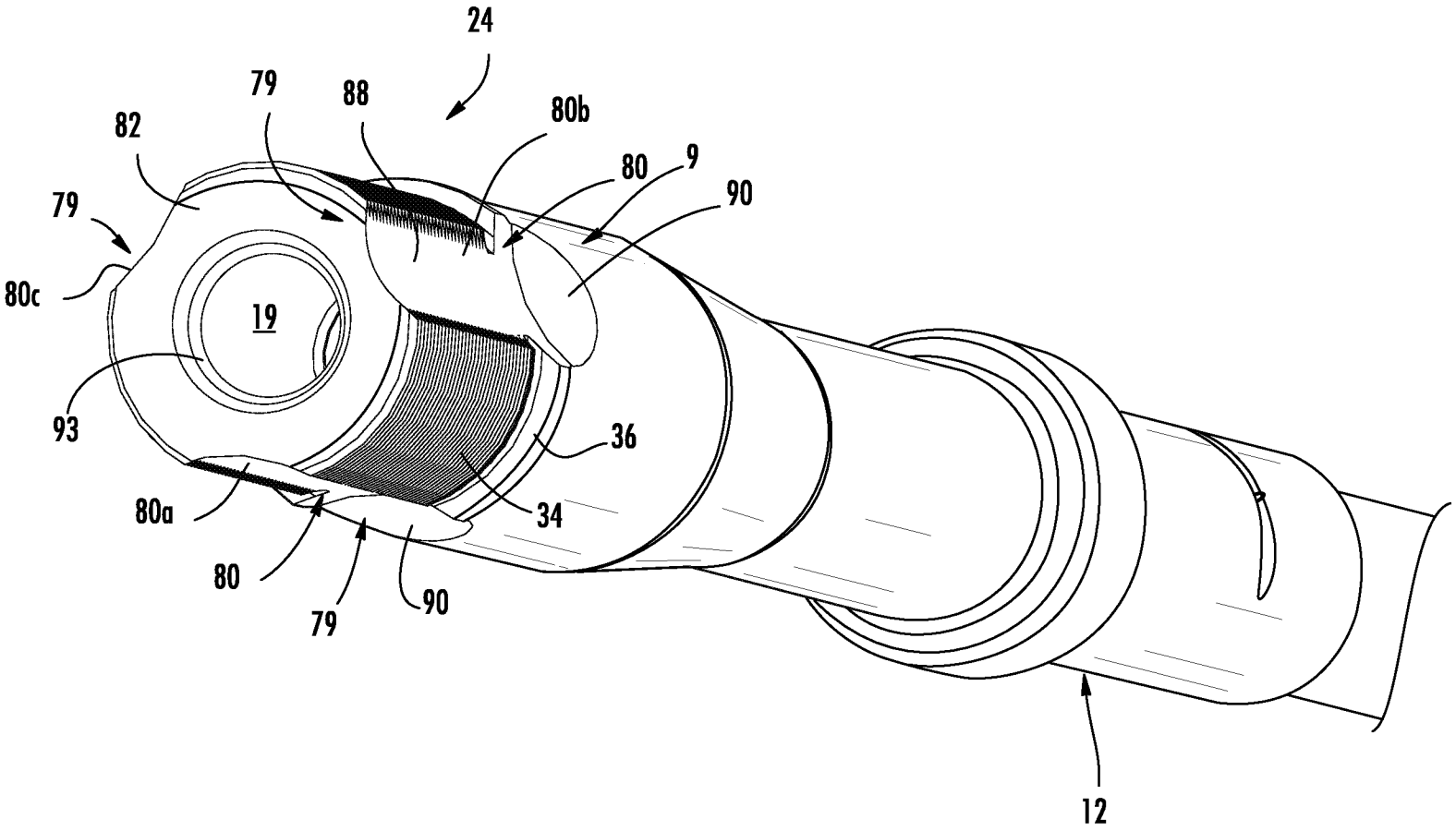
FIGS. 2A-2D are views of the proximal end of the barrel of FIGS. 1B-1D.
Figure 2B:
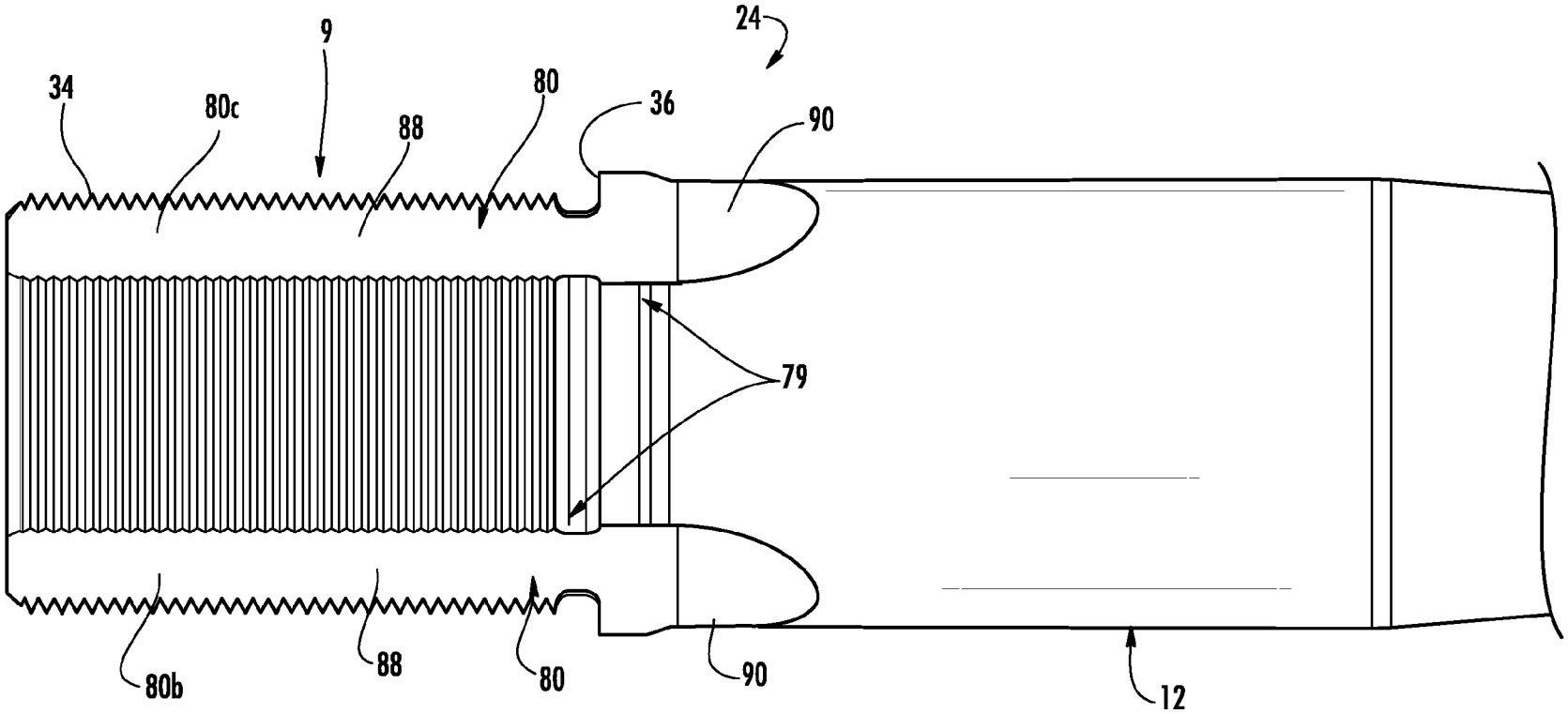
Figure 2C:
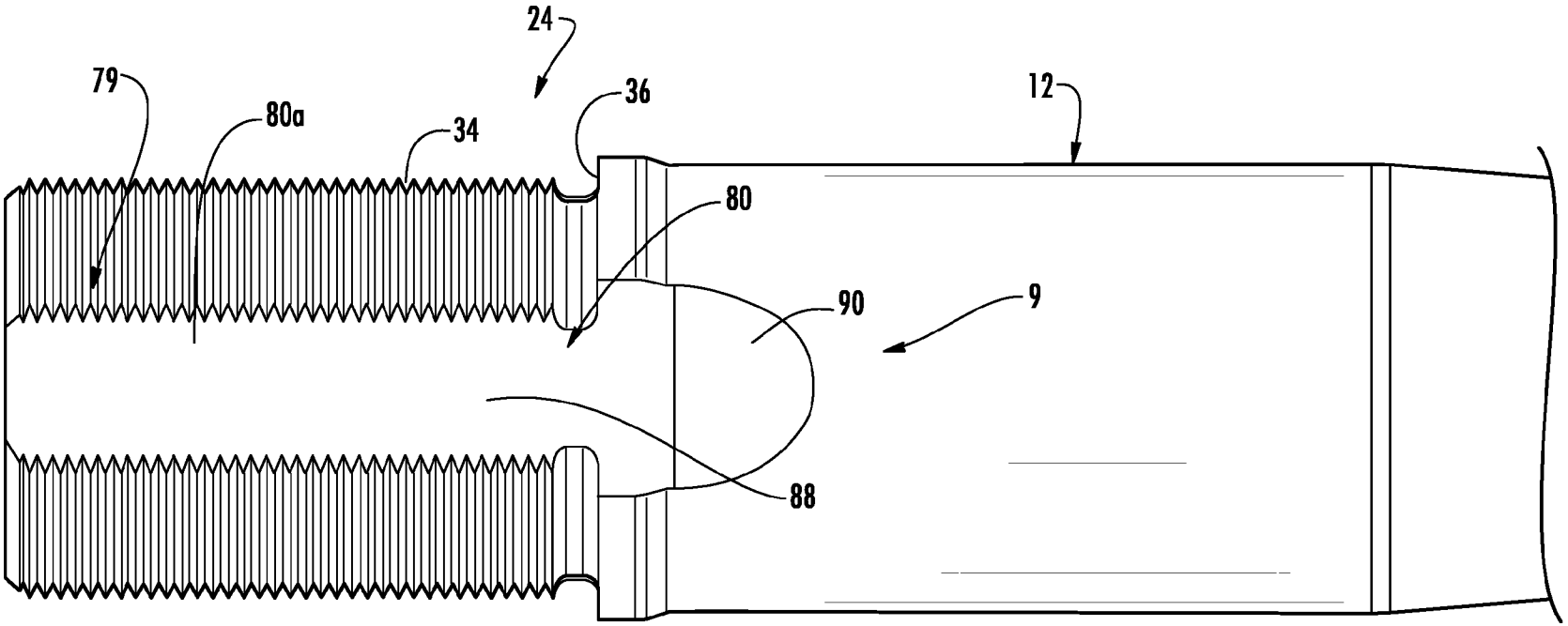
Figure 2D:
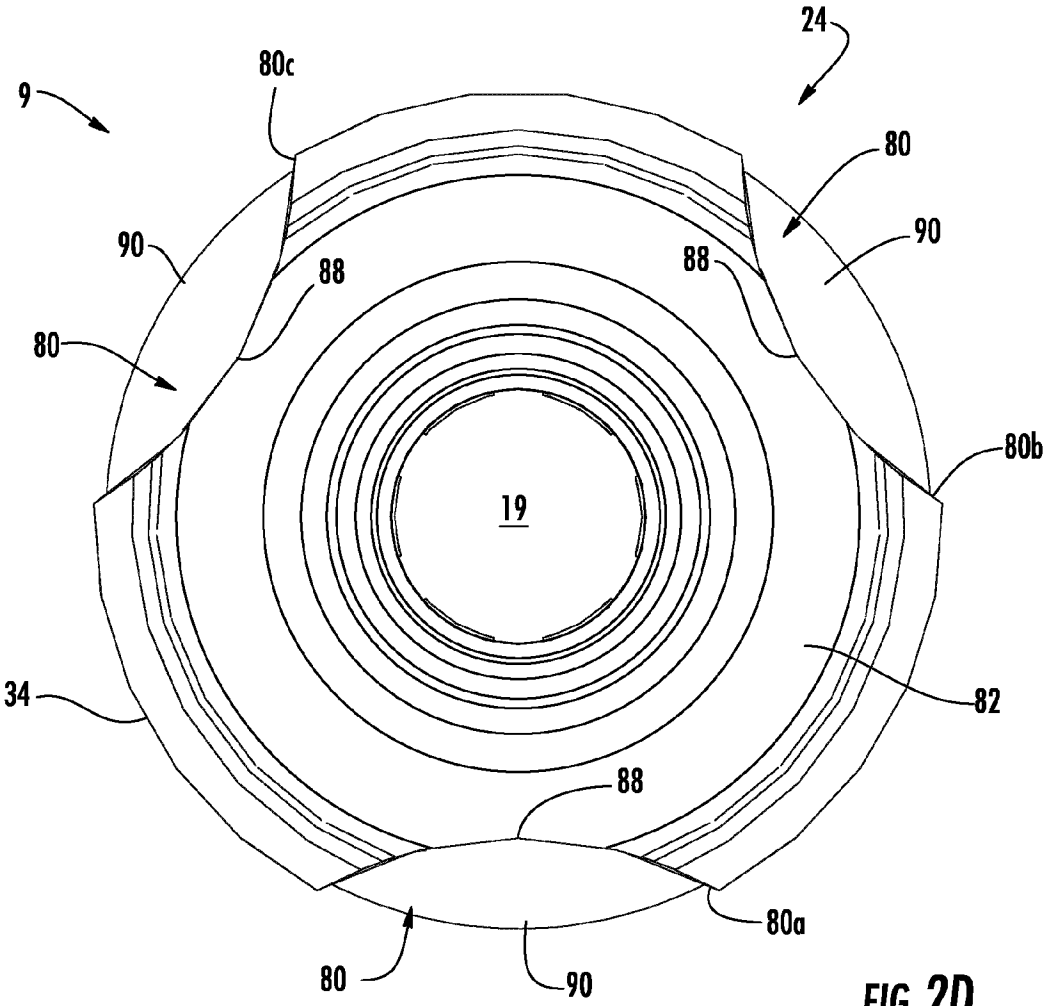
Figure 3A:
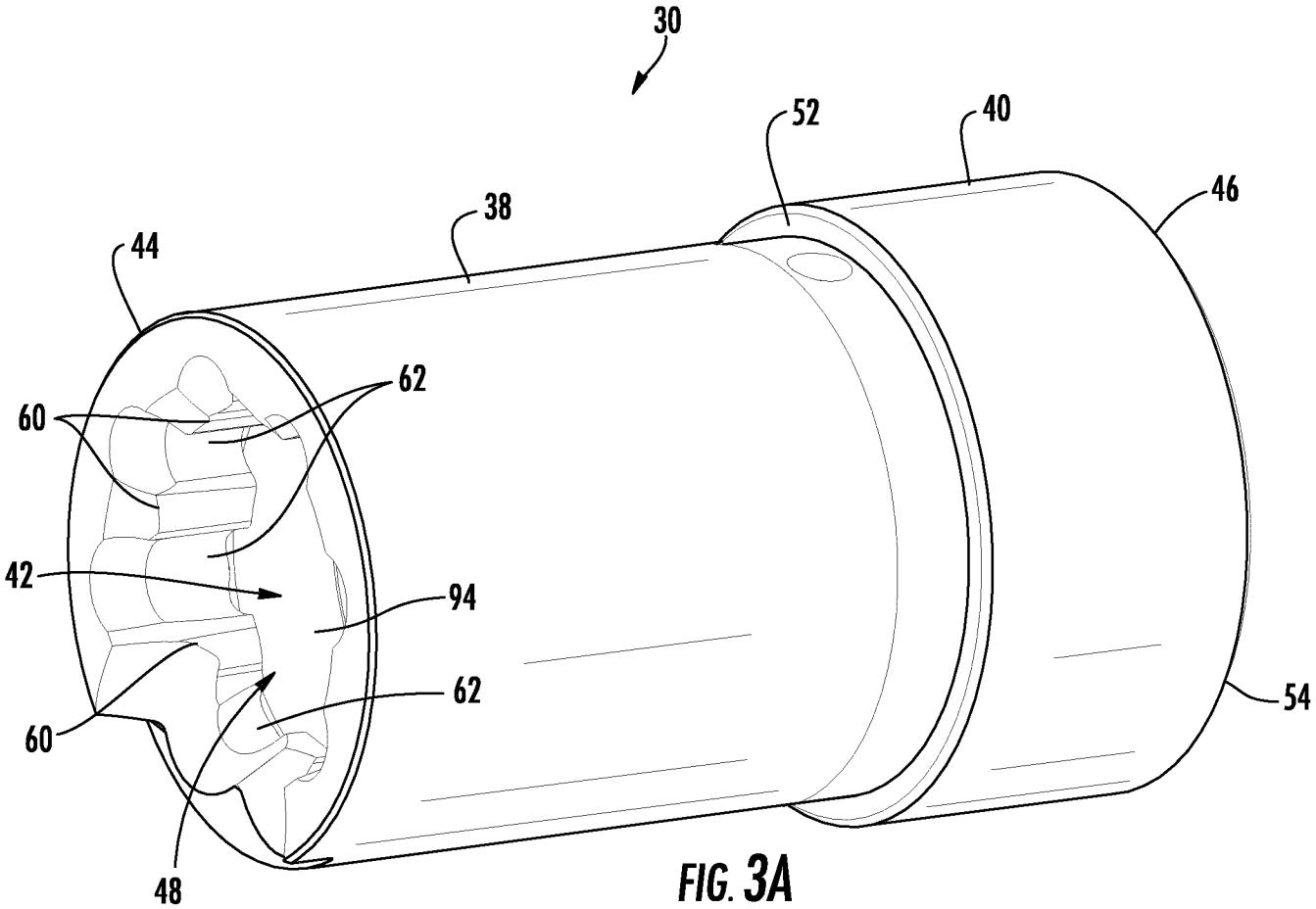
FIG. 3A is an isometric view of the barrel extension of FIGS. 1C and 1D.
Figure 3B:
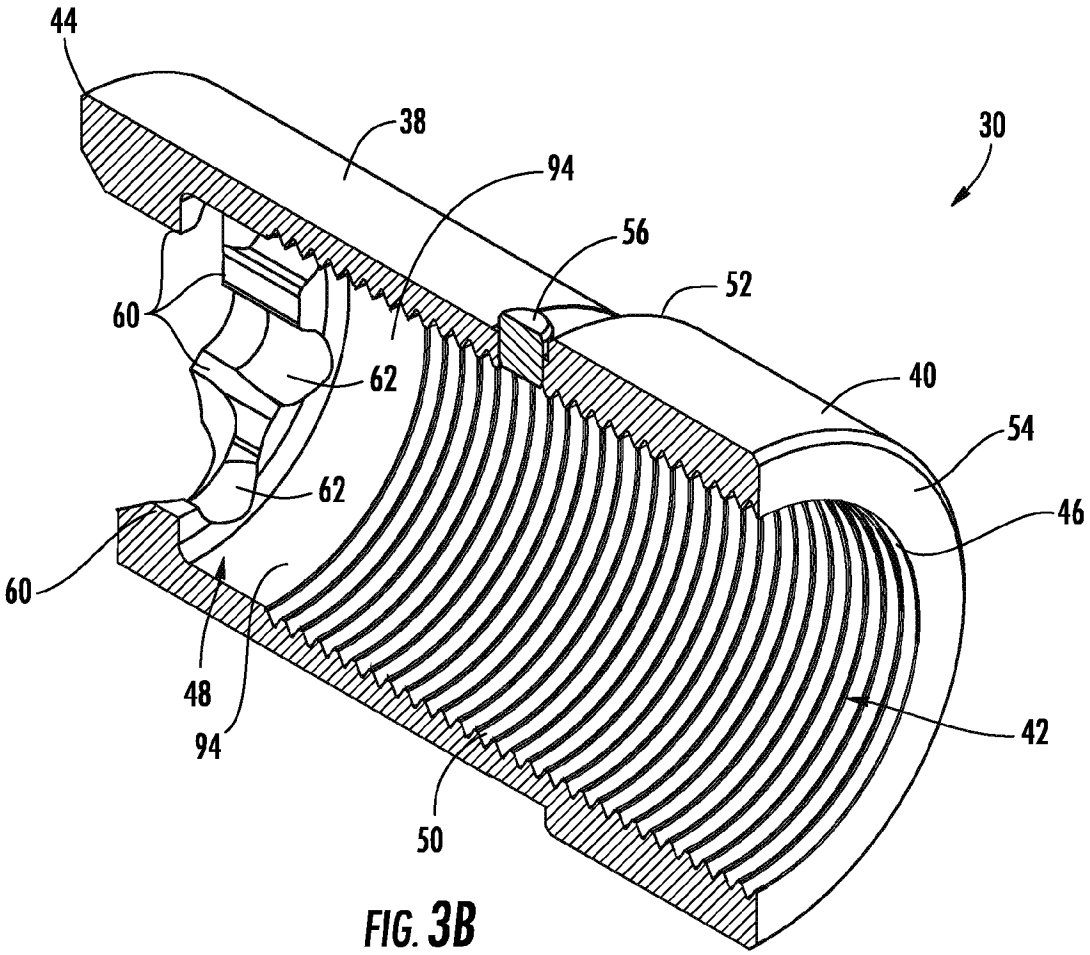
FIG. 3B is an isometric, cross-sectional view of the barrel extension of FIG. 3A.
Figure 7:
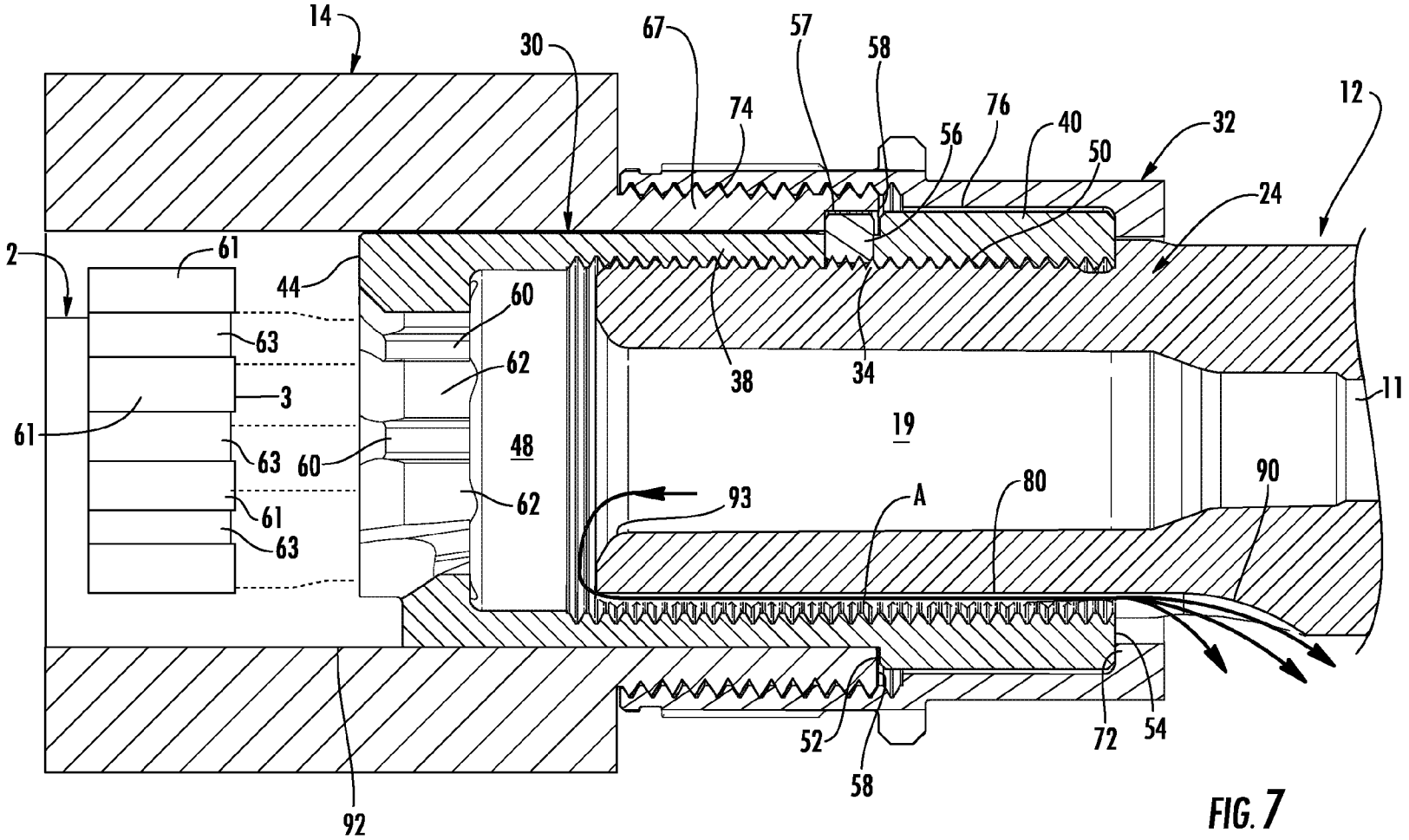
FIG. 7 is a cross-sectional view schematically showing the assembled barrel, barrel extension, and barrel nut mounted on a receiver.

In the illustrated embodiment, the barrel 12 can be retained in abutting relationship with the upper receiver 14 by a barrel extension 30 and a barrel nut 32 (FIGS. 1D and 7). In one embodiment, the barrel mounting apparatus or system 8 (FIGS. 1C, 1D, 4A, and 4B) can include the barrel 12, the barrel extension 30, and/or the barrel nut 32 for coupling the barrel to the upper receiver 14 (FIG. 7). As shown in FIGS. 1B-2C, the proximal end 24 of the barrel further generally will include external threads 34 and a shoulder 36. As shown in FIGS. 1D, 3A, and 3B, the barrel extension 30 can generally include a cylinder section 38 and an annular collar 40. The cylinder section 38 can include an axial bore 42 extending from a bolt-receiving end 44 of the barrel extension 30 to a barrel-receiving end 46 adjacent the collar 40. In the illustrated embodiment, the axial bore 42 can include a bolt interlocking section 48 adjacent the bolt-receiving end 44 and a threaded section 50 extending from the bolt interlocking section 48 to the barrel-receiving end 46 for engaging the external threads 34 in the proximal end 24. As shown in FIGS. 3A and 3B, the collar 40 can include a rear clamp face 52 and a forward clamp face 54, and a locating pin 56 can be disposed adjacent the rear clamp face 52. The locating pin 56 can be press fit into a bore, adhered to the barrel extension, and/or otherwise secured to the barrel extension. The cylinder section 38 can slide axially into the upper receiver 14 (as shown, for example, in FIG. 7) to interface with the bolt assembly 2 of the firearm 10, and the locating pin 56 can be received in a slot or recess 57 (FIG. 7) formed in a forward face 58 of the upper receiver 14 for aligning the barrel and/or the barrel extension with the bolt assembly 2.

As shown in FIGS. 3A and 3B, the bolt-receiving end 44 of the barrel extension 30 further includes a plurality of locking lugs 60 extending radially into the axial bore 42 of the barrel extension 30 with recesses 62 formed between the locking lugs 60. The bolt 3 of the bolt assembly 2 generally will include a plurality of corresponding lugs 61 and recesses 63 at its forward end (shown schematically in FIGS. 1C and 7), with the lugs 61 of the bolt 3 engaging the recesses 62 of the barrel extension 30 while the locking lugs 60 of the barrel extension 30 engage the corresponding recesses 63 of the bolt 3 when the forward end of the breech bolt 3 is passed through the bolt-receiving end 44 and into the interlocking section 48 of the barrel extension 30 when chambering a round R into the chamber 19. Thereafter, with the lugs 61 of the bolt 3 received within the interlocking section 48 of the barrel extension 30, the bolt assembly 2 can be rotated to at least partially align the lugs 61 of the bolt 3 with the locking lugs 60 of the barrel extension 30 to lock the bolt assembly 2 to the barrel extension 30. Upon firing of the round, the bolt assembly 2 will rotate in an opposite direction as it moves rearwardly so that the lugs 61 of the breech bolt 3 are aligned with the recesses 62 of the barrel extension, whereby the bolt 3 can withdraw from the barrel extension 30 to extract the spent shell or cartridge casing from the chamber 19 and chamber another round.

Figure 4A:
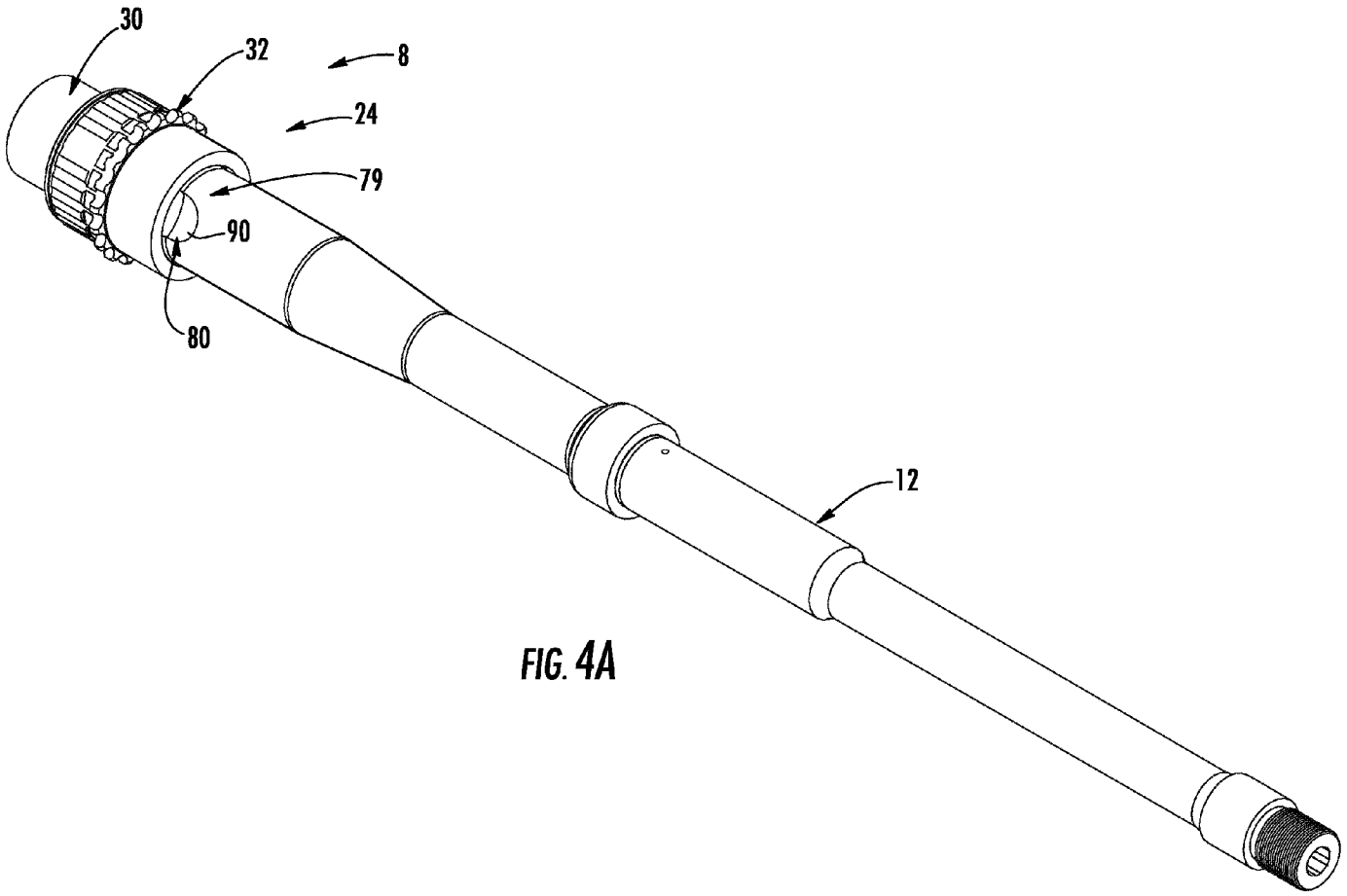
FIG. 4A is an isometric view of the assembled barrel, barrel extension, and barrel nut according to the exemplary embodiment of the disclosure.
Figure 4B:
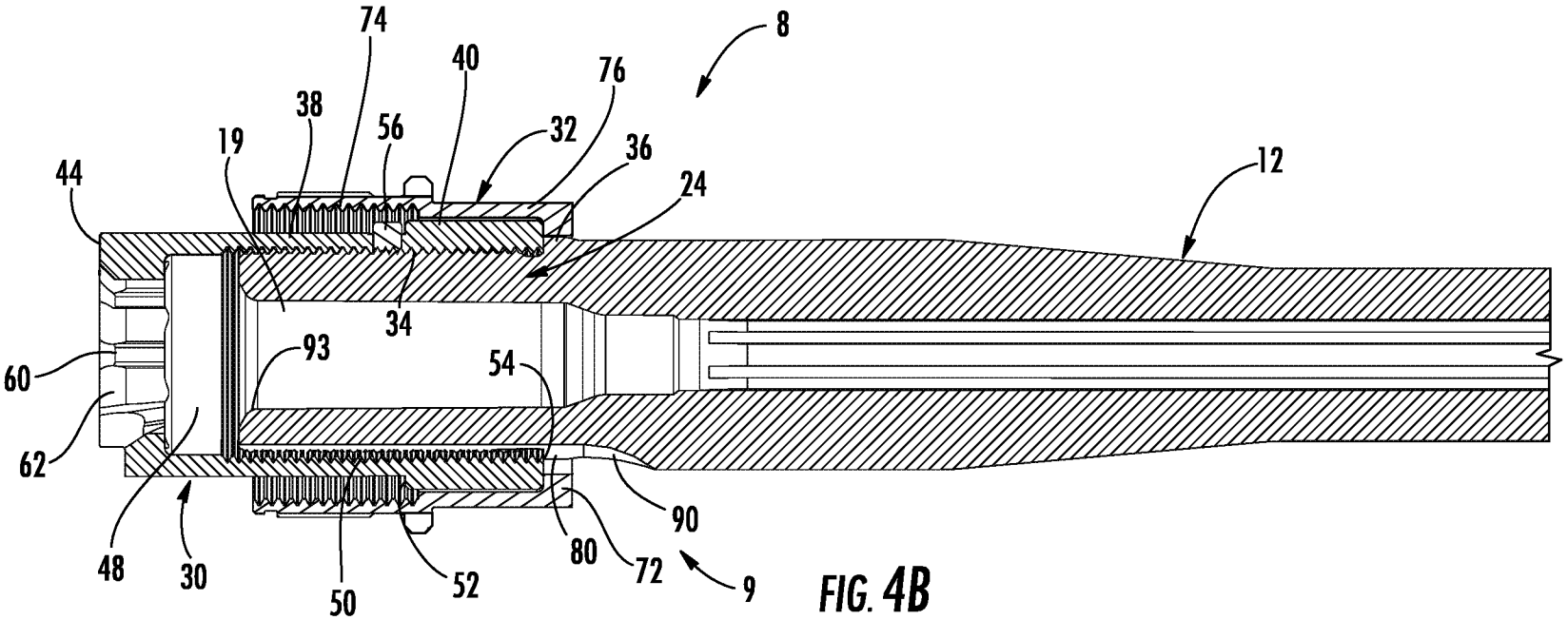
FIG. 4B is cross-sectional view of the assembled barrel, barrel extension, and barrel nut of FIG. 4A.

As shown in FIGS. 1C, 4B, and 7, the threaded section 50 of the axial bore 42 of the barrel extension 30 can receive the proximal end 24 of the barrel 12, which includes at least a portion of the chamber 19. The threaded section 50 can be threaded for interfacing with the external threads 34 formed about the proximal end 24 of the barrel 12 for attaching the barrel to the barrel extension. The collar 40 can engage and abut against the shoulder 36 proximate the external threads 34 of the barrel 12 when the barrel extension 30 is in engagement with the proximal end 24 of the barrel.

In the illustrated embodiment, the rearward clamp face 52 of the collar 40 of the barrel extension 30 extends outwardly from the cylinder section 38 in a generally radial direction to provide a generally flat rearward-facing surface for engaging the forward facing surface 58 of the upper receiver 14 (FIG. 7). Accordingly, a clamp force applied along the longitudinal axis L of the barrel 12 tends to urge the rearward face 52 against the forward surface of the receiver. The rearward face 52 of the collar further can be formed with a generally flat configuration to help facilitate proper seating of the collar 40 against the upper receiver 14 for substantially secure retention of the barrel extension 30, and thus the barrel 12, to the upper receiver 14, as well as proper alignment of the longitudinal axis L of the barrel 12 with a longitudinal axis of the receiver, with minimal effort by a user.

In the illustrated embodiment, the alignment pin 56 is seated in a bore in the cylinder section 38 of the barrel extension 30 and is secured by adhesive or an interference fit with the bore, for example. Alternatively the alignment pin 56 can be integral with the cylinder section 38 and/or the collar 40. The alignment pin 56 can be configured so that when the alignment pin 56 engages the recess 57 in the upper receiver 14 (FIG. 7), the bolt interlocking section 48 of the barrel extension 30 is properly aligned within the receiver to receive the forward portion of the bolt assembly and to interlock with the bolt assembly. The barrel extension 30 could be otherwise configured or omitted without departing from the disclosure.

Figure 5A:
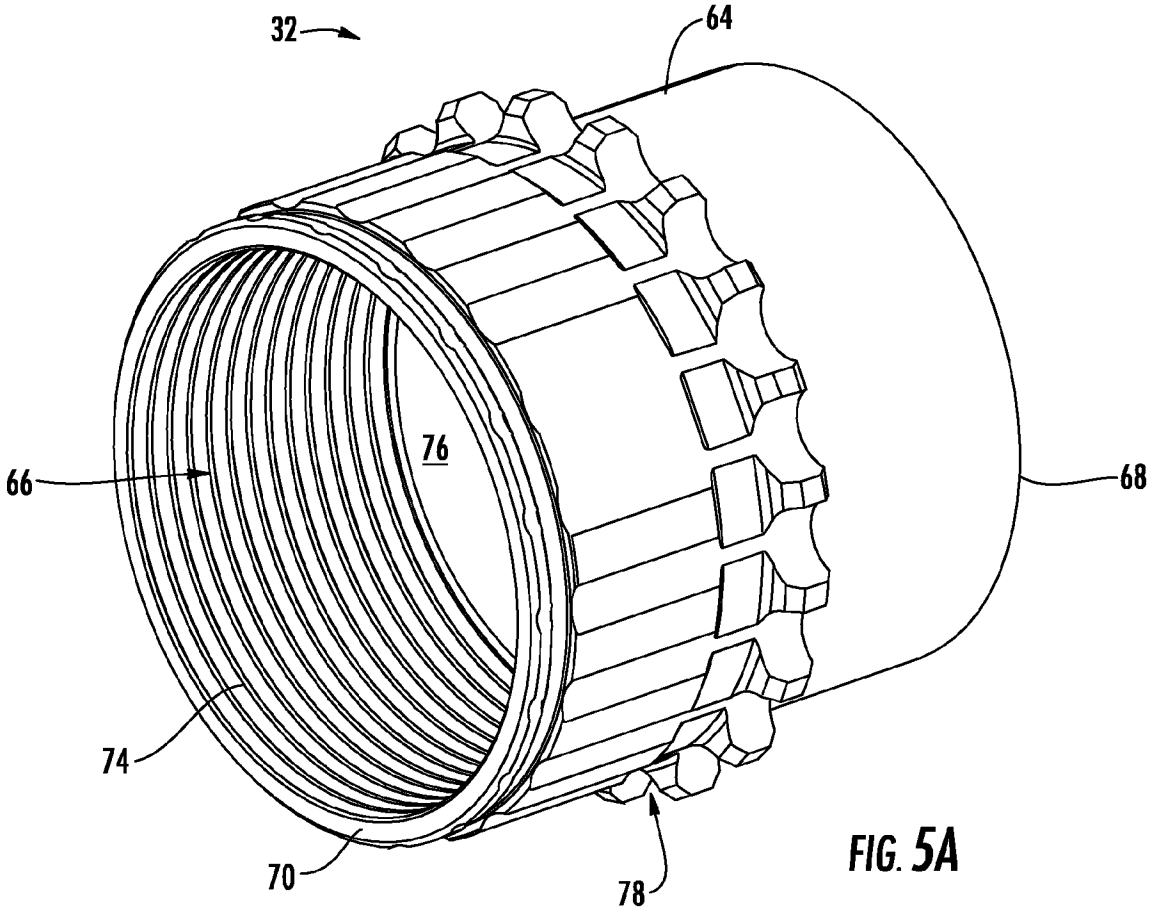
FIG. 5A is an isometric view of the barrel nut of FIG. 1D.
Figure 5B:
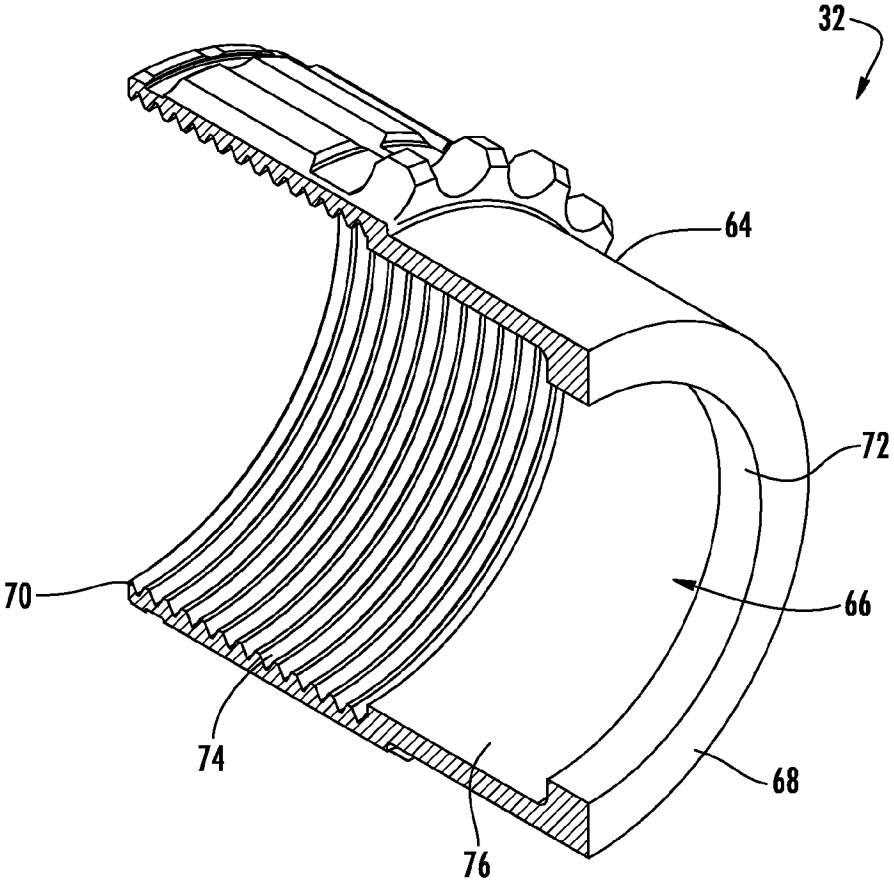
FIG. 5B is an isometric, cross-sectional view of the barrel nut of FIG. 5A.

As illustrated in FIGS. 1D, 5A, and 5B, the barrel nut 32 can include a body 64 defining an axial bore 66. The axial bore 66 can provide clearance for the proximal end 24 and the shoulder 36 of the barrel 12 to pass through and engage the barrel extension 30. Accordingly, the barrel nut 32 can slide over and along the barrel 12 to engage the collar 40 (FIGS. 4B and 7) of the barrel extension 30 and a front end 67 of the receiver 14 (FIG. 7). In the illustrated embodiment, the barrel nut 32 includes a forward end 68, a rearward end 70, an annular shoulder 72, and a threaded portion 74 extending adjacent the rearward end 70. A collar-receiving portion 76 can extend between the threaded portion 74 and the annular shoulder 72 for receiving the collar 40 of the barrel extension 30. The threaded portion 74 can be configured for engaging external threads formed on the forward end 67 of the upper receiver 14.

In one embodiment, the barrel nut 32 also can include gripping features 78 (FIG. 5A), which can help tighten and loosen the barrel nut on the forward end of the upper receiver 14. As shown in FIG. 5A, the gripping features 78 include circumferentially-spaced groves and ridges adjacent a series of projections. Other gripping features could be included or the gripping features could be omitted without departing from the disclosure. The barrel nut 32 could be otherwise configured or omitted without departing from the disclosure. Still further, it also will be understood that, in some embodiments, the barrel can be attached to the upper receiver without the barrel extension using the barrel nut.

As shown in FIGS. 2A-2D, the gas vent feature 9 can include one or more high pressure gas vents 79 formed in the proximal end 24 of the barrel 12. In the illustrated embodiment, the high pressure gas vents 79 are shown as slots, recesses, depressions, or channels 80 extending in a direction substantially parallel to the longitudinal axis L of the barrel 12. In the illustrated embodiment, the gas vents 79 are shown as comprising three channels 80 (labeled as channels 80*a*, 80*b*, and 80*c* in FIGS. 2A-2D) that are generally evenly spaced along the circumference of the proximal end 24. In alternative embodiments, fewer or additional vents or channels can be used, and the vents further could be provided/formed with other, different configurations, and/or arranged differently about the barrel. For example, the channels could be spaced apart by varying distances and/or could be at least partially curved, slanted, angled or otherwise oriented.

In one alternative embodiment, one or more vents could be provided and each could include a series of grouped channels extending from the rearward end of the proximal end 24 of the barrel 12 and converge into a single channel between the rearward end and the shoulder 36 of the barrel. The single channel formed from the converged channels could be larger, and could then extend forward past the shoulder 36. In another alternative embodiment, at least one vent 79 could be formed as or include a channel or slot extending along at least a portion of the proximal end of the barrel from the rearward end of the barrel and can thereafter be split into two or more diverging channels in the proximal end, each of which channels can extend forwardly past the shoulder 36 of the barrel to help diffuse the exiting gases.

Figure 6:
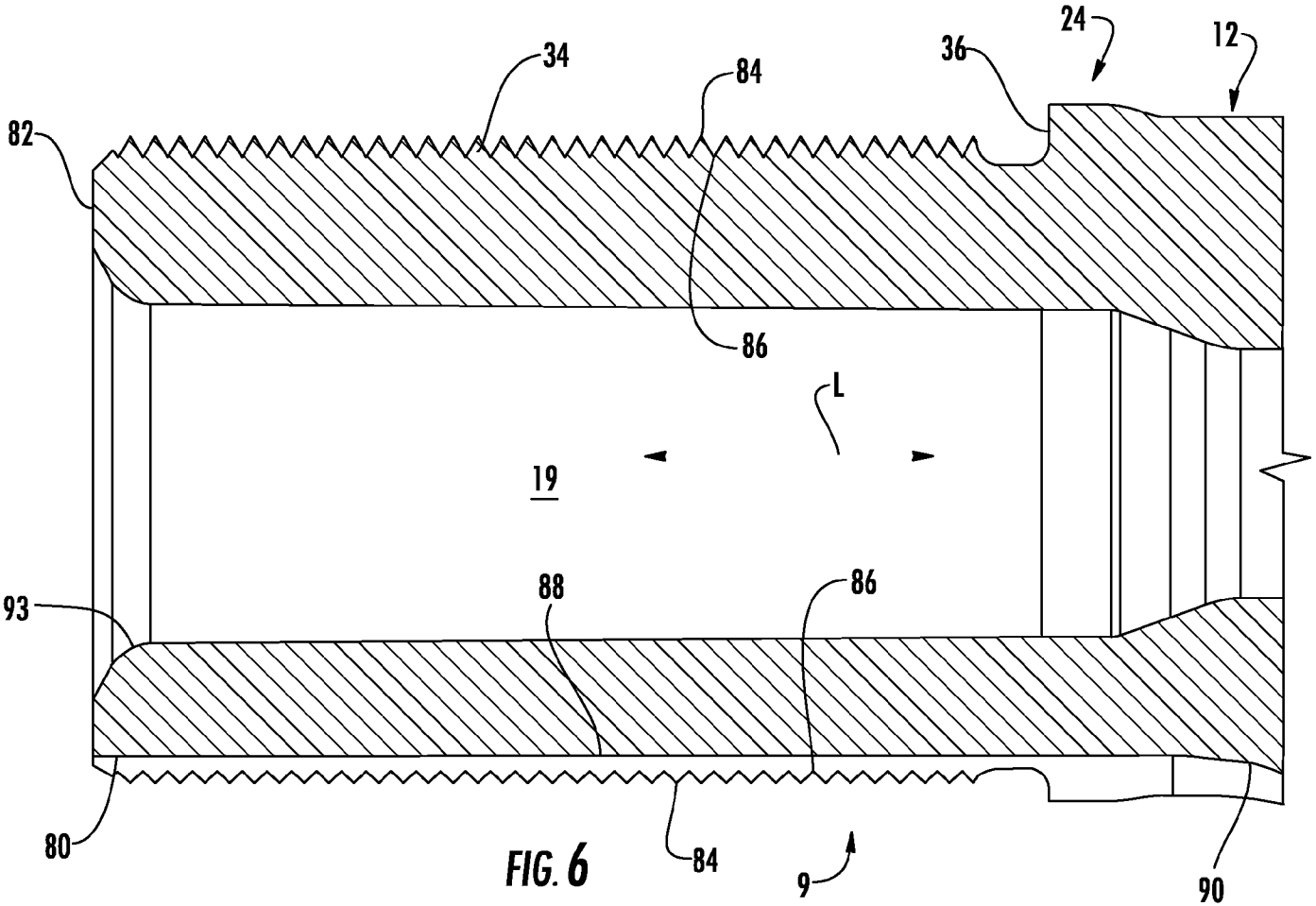
FIG. 6 is a cross-sectional view of the proximal end of the barrel of FIGS. 2A-2D.

In the illustrated embodiment, the gas vent channels 80 can extend from a rearward face 82 of the proximal end 24 of the barrel 12 adjacent a breech end 93 of the chamber 19, through the threads 34 of the barrel, and through the shoulder 36, although channels of greater or lesser lengths also can be provided. In one embodiment, as shown in FIG. 6, the threads 34 can have a major radius 84 (e.g., from the longitudinal axis L of the barrel 12) corresponding to the outermost edges of the threads and a minor radius 86 corresponding to the base of the grooves between the threads, and a lowermost surface 88 of each channel 80 can be below the minor radius 86 of the threads (e.g., the radius of the barrel at the lowermost surface 88 can be less than the radius of the barrel at the minor radius 86 of the threads). As shown in FIGS. 2A and 6, the depth of the channels 80 can decrease at the forward end 90 of the channels adjacent the shoulder 36 of the barrel 12. Accordingly, as gas vents through the channels 80, the tapered forward ends 90 of the channels can gradually direct the expanding excess combustion gases slightly outwardly and away from the barrel 12. In an alternative embodiment, the forward ends of the gas vent channels 80 could direct the gas in an alternative direction (e.g., in a direction generally parallel to the longitudinal axis L of the barrel 12). The channels 80 can be formed by machining (e.g., by a mill or other suitable tool), or the channels could be otherwise formed in the proximal end 24.

In an alternative embodiment, where a barrel extension is not used, for example, with the barrel can be directly connected to the upper receiver. For example, the barrel extension feature could be incorporated into (e.g., integral with) the barrel so that the proximal end engages the receiver in a similar manner as the barrel extension 30 and/or the proximal end could be threaded for engagement with an internally threaded receiver bore. The gas vent channels can be formed along the exterior of the proximal end of the barrel (as discussed above) whether the proximal end is threaded or not. Corresponding channels further could be formed in the receiver bore or the barrel nut although it is not necessarily required.

As shown in FIGS. 1D, 4A, and 4B, the barrel 12, the barrel extension 30, and the barrel nut 32 can be assembled for attachment to the upper receiver 14 by inserting the proximal end 24 of the barrel 12 through the axial bore 66 of the barrel nut 32 and threading the threads 34 of the proximal end 24 into the threaded section 50 of the barrel extension 30 until the forward end 54 of the barrel extension 30 abuts the shoulder 36 of the barrel 12. The threaded engagement between the threads 34 of the barrel and the threaded section 50 of the barrel extension generally will provide a substantially gas-tight seal/engagement between the barrel extension 30 and the proximal end 24 of the barrel, except for the gas vent channels 80, which interrupt the threads 34. Accordingly, the channels 80 can provide a passageway for gases generated upon firing and which otherwise could be contained in the chamber 19, such as, for example, following a cartridge mis-fire or other failure. The passageway can be interior to the threads of the threaded section 50 so that these gases may be vented along the channels, between the proximal end 24 of the barrel and the barrel extension 30, and will be directed away from the shooter.

As shown in FIG. 7, the cylinder section 38 of the barrel extension 30 can be inserted into a receiver opening 92 in the forward end 67 of the upper receiver 14 (e.g., by a sliding engagement between the exterior surface of the cylinder section 38 and the inner surface of the receiver opening 92). With the alignment pin 56 of the barrel extension 30 received in the recess 57 in the forward face 58 of the upper receiver 14, the threaded portion 74 of the barrel nut 32 can be threaded onto the externally-threaded forward end 67 of the upper receiver 14 until the annular shoulder 72 of the barrel nut 32 engages the forward clamp face 54 of the collar 40 and forces the barrel extension 30 rearwardly. Continued turning of the barrel nut 32 can force the rearward clamp face 52 of the collar 40 against the forward face 58 of the upper receiver 14 and clamp the collar 40 between the annular shoulder 72 and the forward face 58 of the upper receiver. The barrel 12, the barrel extension 30, and the barrel nut 32 otherwise can be assembled and or coupled to the forward end 67 of the receiver.

In the event of a failure of a cartridge in the chamber 19 (e.g., during a firing operation), gases from combustion of the propellant from the cartridge can build up pressure in the chamber and/or the receiver, especially if the bore 11 of the barrel 12 is blocked by the failed cartridge. However, the pressurized gases can escape from the chamber and receiver through the channels 80. Accordingly, the gases can travel through the rear end 82 of the barrel 12 at the breech end 93 of the chamber 19 and into the channels 80, being directed along the channels, between the threads 36 of the barrel 12 and/or the threaded section 50 of the barrel extension in the direction of arrow A as indicated in FIG. 7. As the gases travel along the gas vent channels 80, the forward portions 90 of the channels can gradually direct the gases slightly outwardly from the barrel 12 so as to enable the gases to further spread and/or diffuse as they exit the channels. After the gases pass by the shoulder 36 of the barrel and through the forward portions 90 of the channels 80, the gases can continue traveling forward of the forward end 67 of the receiver, away from the user. In this way, the channels 80 can help protect the user from rearwardly directed gases, which can be at a high pressure, can be hot, and/or can carry debris, by providing a directed vent arrangement or mechanism through the forward end of the receiver. Additionally, the channels 80 can help protect the components of the firearm from build-up undesirable high gas pressures.

Generally, the assembly including the barrel 12 and the barrel extension 30 essentially can create a nearly sealed volume. However, the one or more gas vents 79 according to the invention allow for the creation of interrupted threads on either the barrel 12 or the barrel extension 30. For example, as illustrated in FIGS. 1D-2A, the channels 80 in the proximal end 24 of the barrel 12 can interrupt the threads 34 of the barrel, or, in an alternative embodiment, one or more channels could be formed in the interior surface 94 (FIGS. 1C and 3A-3B) of the barrel extension 30 and interrupt the threads of the threaded section 50. The interruption of the threads generally can be such that the material is removed from the barrel and/or the barrel extension that is deeper than the minor radius of the thread pitch, sufficient to create an open channel therealong that will allow gases (e.g., high pressure gases) to be vented and directed in a direction away from the shooter (i.e., forward of the barrel extension) in the event of a cartridge failure. The barrel and barrel extension assembly and/or the gas vent channels also could be otherwise configured.

In an alternative embodiment, the barrel extension 30 and/or the barrel nut 32 could be omitted. For example, the receiver opening 92 of the upper receiver 14 could be internally threaded for engaging the external threads 34 of the barrel 12. In such an alternative embodiment, the gas vent channels 80 in the proximal end 24 of the barrel can provide a gas passageway that is interior to the internal threads (not shown) of the receiver opening 92 for allowing gases in the chamber 19 to vent along the channels to exit the receiver 14 toward the muzzle end 13 of the barrel. As still a further alternative, the proximal end 24 of the barrel could be similarly threadedly engaged with the receiver opening 92; however, the one or more gas vent channels could be formed in the inner surface of the receiver opening 92 to provide a gas passageway that is exterior to the threads 34 of the barrel.

Figure 8A:
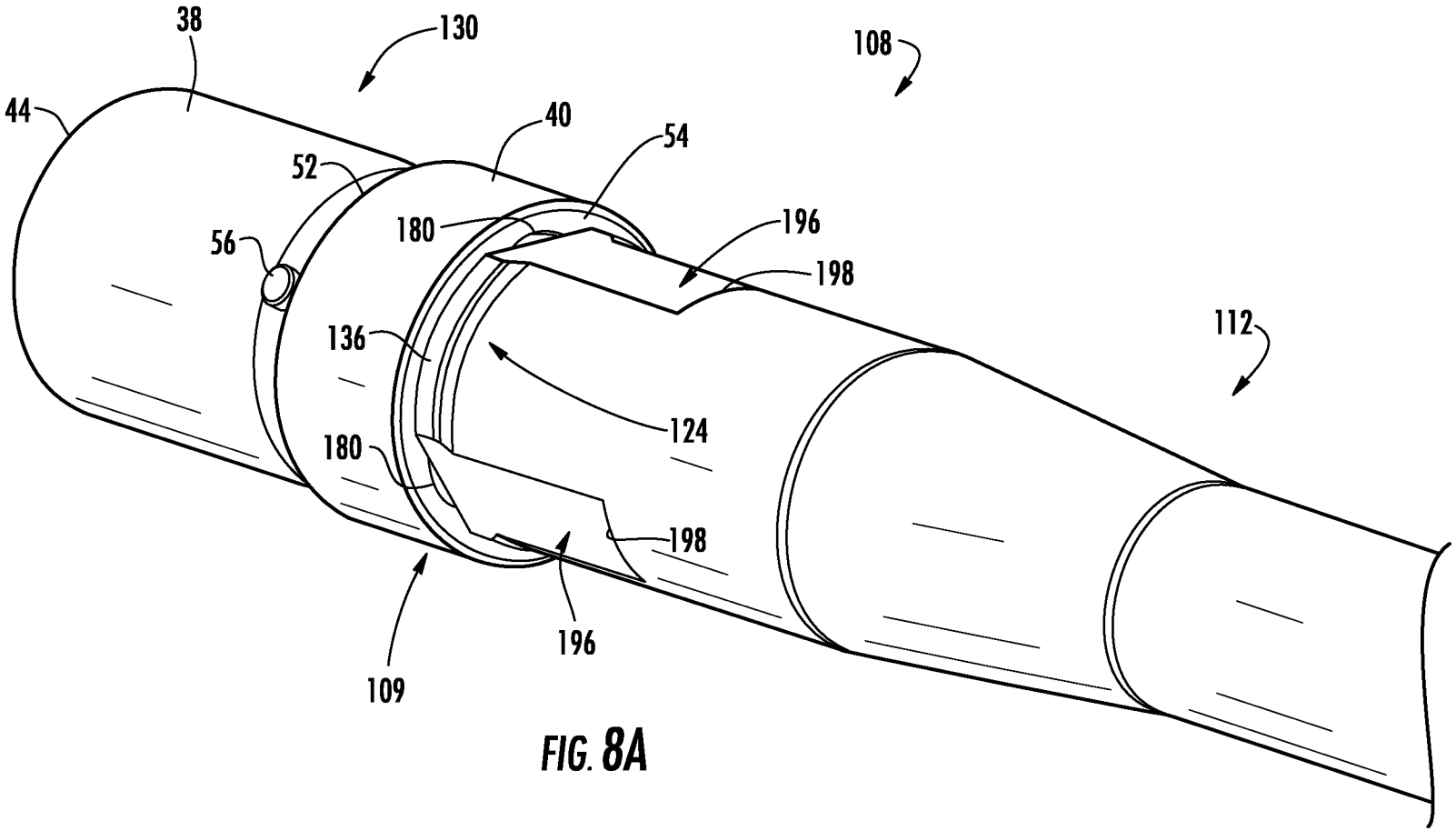
FIG. 8A is an isometric view of a barrel mounting apparatus according to a second embodiment of the disclosure.
Figure 8B:
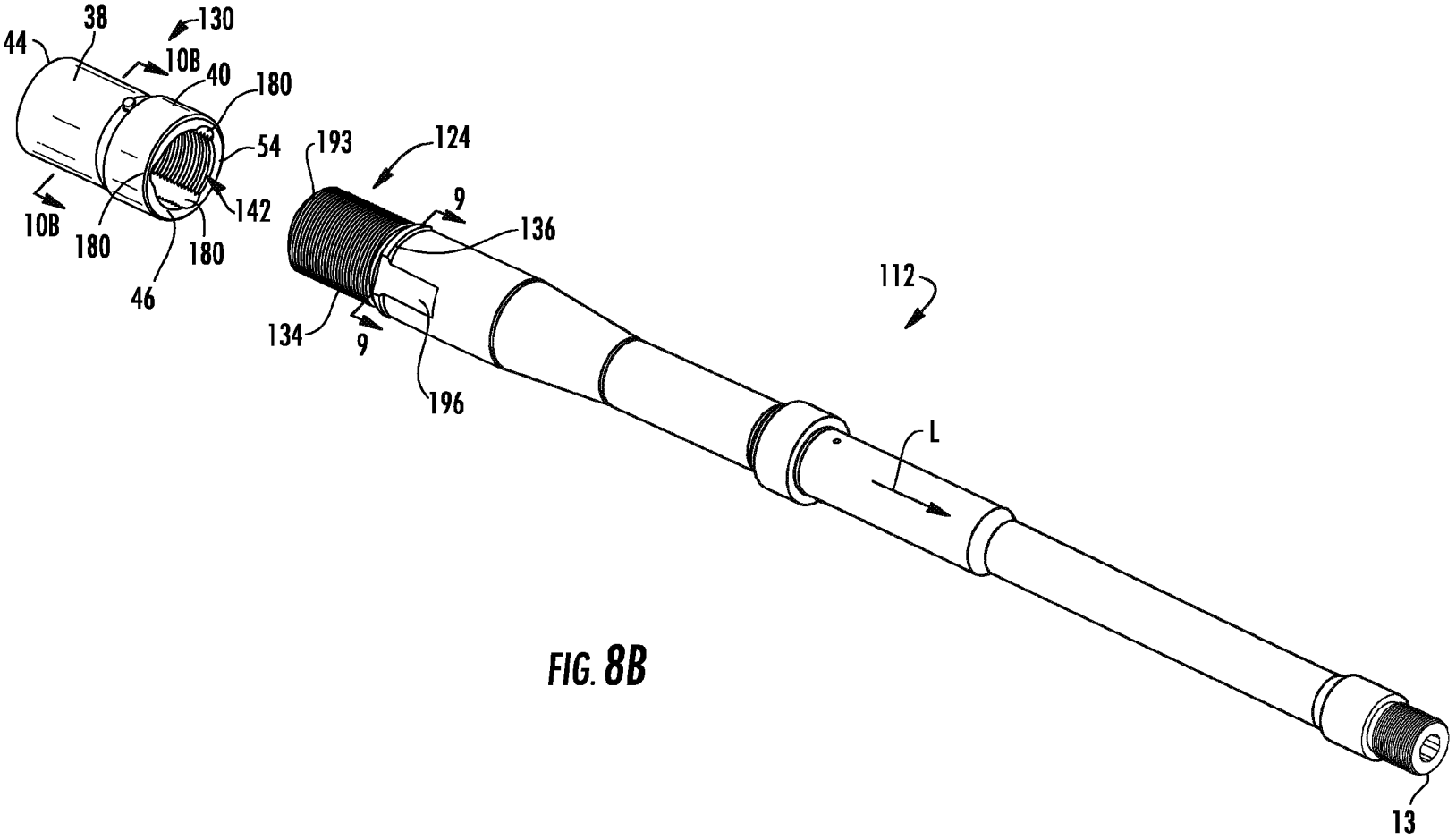
FIG. 8B is an isometric exploded view of a barrel and a barrel extension according to the second embodiment of the disclosure.

FIGS. 8A and 8B are isometric views of a barrel mounting system 108 for a firearm (e.g., the firearm 10 of FIG. 1A) according to an additional example embodiment of the disclosure. This second embodiment generally is similar to the first embodiment, except for variations noted and variations that will be apparent to one of ordinary skill in the art. Accordingly, similar or identical features of the embodiments have been given like or similar reference numbers. In one embodiment, the barrel mounting system 108 can be generally interchangeable with the barrel mounting system 8 of the first embodiment (e.g., as shown in FIGS. 1C, 1D, 4A, and 4B).

Figure 9:
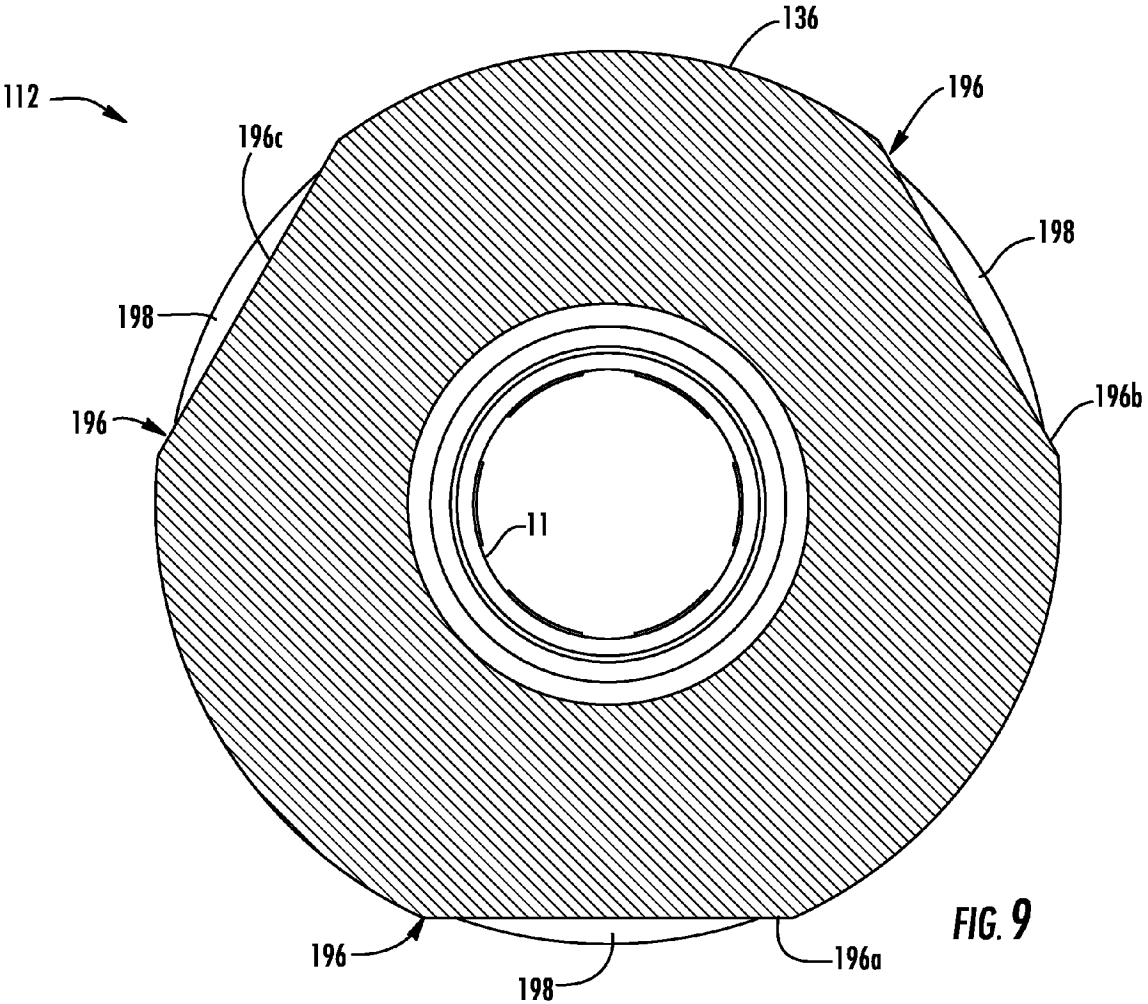
FIG. 9 is a cross-sectional view of the barrel of FIG. 8B taken along line 9-9.

In this embodiment, illustrated in FIGS. 8A-11, the barrel extension 130 and the barrel 112 are substantially the same as the barrel extension 30 and the barrel 12 of the first embodiment. In this embodiment, the gas vent feature 109 (FIG. 8A) is shown as including channels 180 formed in the axial bore 142 (e.g. in the interior surface 194) of the barrel extension 130 instead of in the exterior surface of the barrel. As shown in FIGS. 8A and 8B, the gas vent feature 109 includes channels 180 (e.g., three channels 180*a*, 180*b*, 180*c* that are generally evenly spaced along the circumference of the axial bore 142 as shown in FIG. 10B) and reliefs 196 formed in the exterior surface of the barrel 112 adjacent to the proximal end 124. In the illustrated embedment, the reliefs 196 can comprise three reliefs 196*a*, 196*b*, 196*c* that are generally evenly spaced along the circumference of the barrel 112 (FIG. 9). As shown in FIG. 8A, when the barrel extension 130 is coupled to the proximal end 124 of the barrel 112 (e.g., by threaded engagement), the collar 40 of the barrel extension 130 can abut the shoulder 136 of the barrel 112 and the channels 180 in the axial bore 142 generally can be aligned with the respective reliefs 196 in the exterior surface of the barrel 112. The barrel extension 130, the barrel 112, and/or the gas vent feature 109 could be omitted or could be otherwise shaped, arranged, and/or configured without departing from the disclosure. For example, the gas vent feature could include channels 80 in the proximal end of the barrel in addition to the channels 180 in the barrel extension 130. In another alternative, the gas vent feature could include a different number of channels 180 and/or reliefs 196. Further, the channels 180 and/or the reliefs 196 could have different shapes and/or configurations (e.g., converging and/or diverging configurations).

Figure 10A:
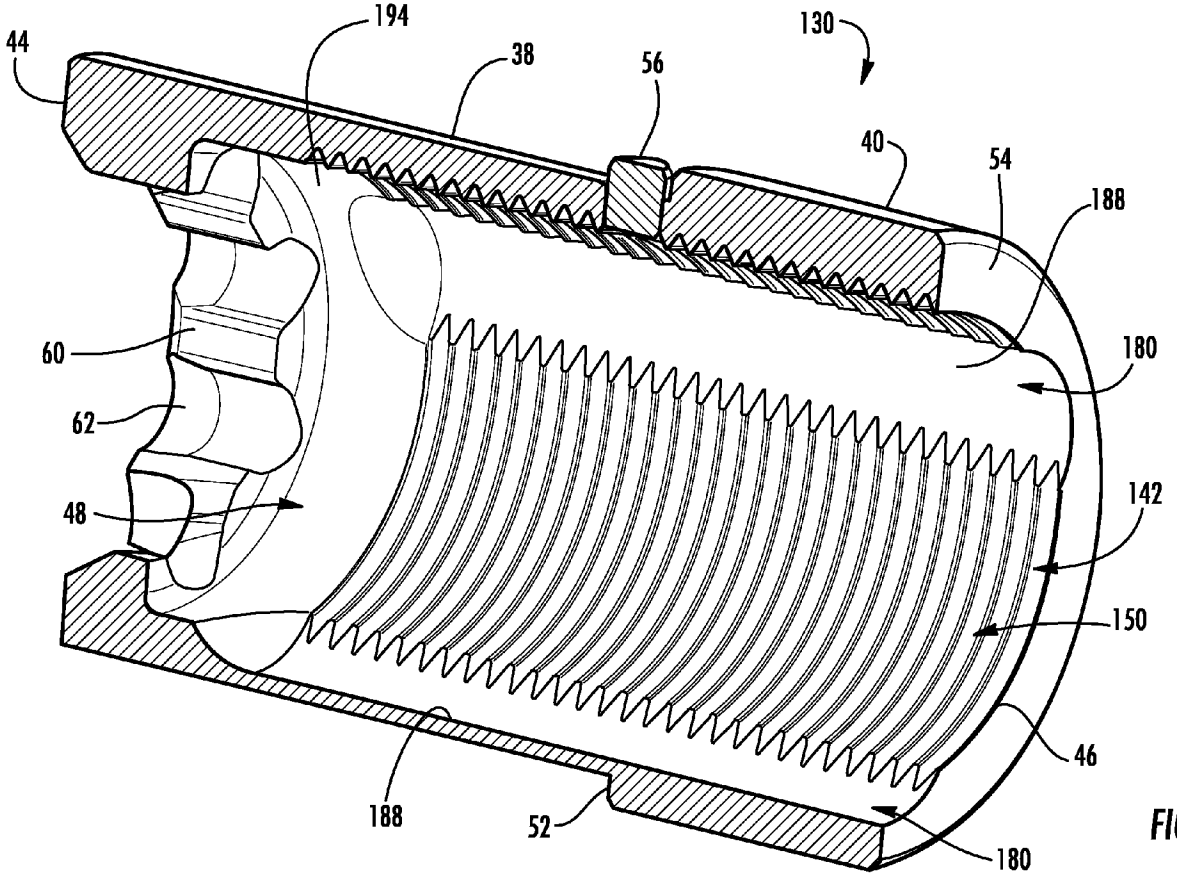
FIG. 10A is an isometric, cross-sectional view of the barrel extension of FIG. 8B.
Figure 10B:
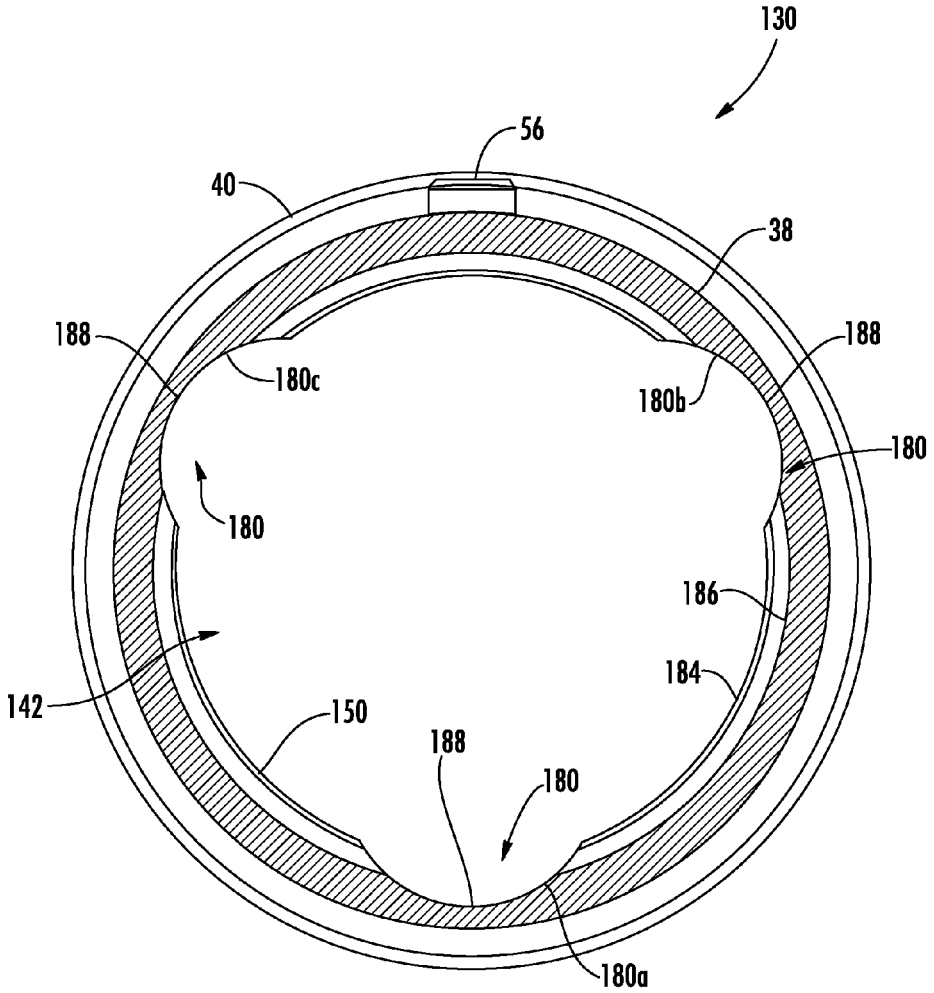
FIG. 10B is a cross-sectional view of the barrel extension of FIG. 8B taken along line 10B-10B.

As shown in FIGS. 10A and 10B, the gas vent channels 180 are formed in the interior surface 194 of the barrel extension along the axial bore 142 and extending from the bolt interlocking section 48 along the threaded section 150 to the barrel-receiving end 46. In alternative embodiments, channels with different lengths could be provided. The channels 180 can extend into the interior surface 194 deeper than the threads of the threaded portion 150 as shown in FIG. 10B so that the lowermost surface 188 (e.g., with respect to the interior surface 194) is lower than the grooves between the threads of the threaded portion 150. Stated another way, the grooves between the threads can have a reduced or smaller radius (e.g., from the centerline of the axial bore 142) than the radius of the lowermost surface 188. Accordingly, the channels 180 can interrupt the threads to form a passageway exterior to the threads 134 of the barrel 112 when the barrel extension 130 is assembled onto the proximal end 124 of the barrel 112 (FIG. 8B).

As shown in FIGS. 8A, 8B, and 9, the reliefs 196 are formed in the exterior surface of the barrel 112 and extend in the shoulder 136 and a portion of the barrel that is forward of the shoulder 136 so that the reliefs 196 are adjacent the proximal end 124 of the barrel. The reliefs 196 can have a radius (e.g., from the longitudinal axis L of the barrel 112) that is less than the radius of the shoulder 136 and the exterior surface of the barrel forward of the shoulder 136 so that the shoulder 136 does not block the channels 180 at the forward face 54 of the barrel extension 130 (FIG. 8A). Each of the reliefs 196 can include a forward end 198 that is spaced apart from the shoulder 136. In the illustrated embodiment, the forward ends 198 extend radially from the reliefs 196 to form rearward faces. Alternatively, the forward ends 198 could be tapered similar to the forward portions 90 of the channels 80 in the first embodiment.

Figure 11:
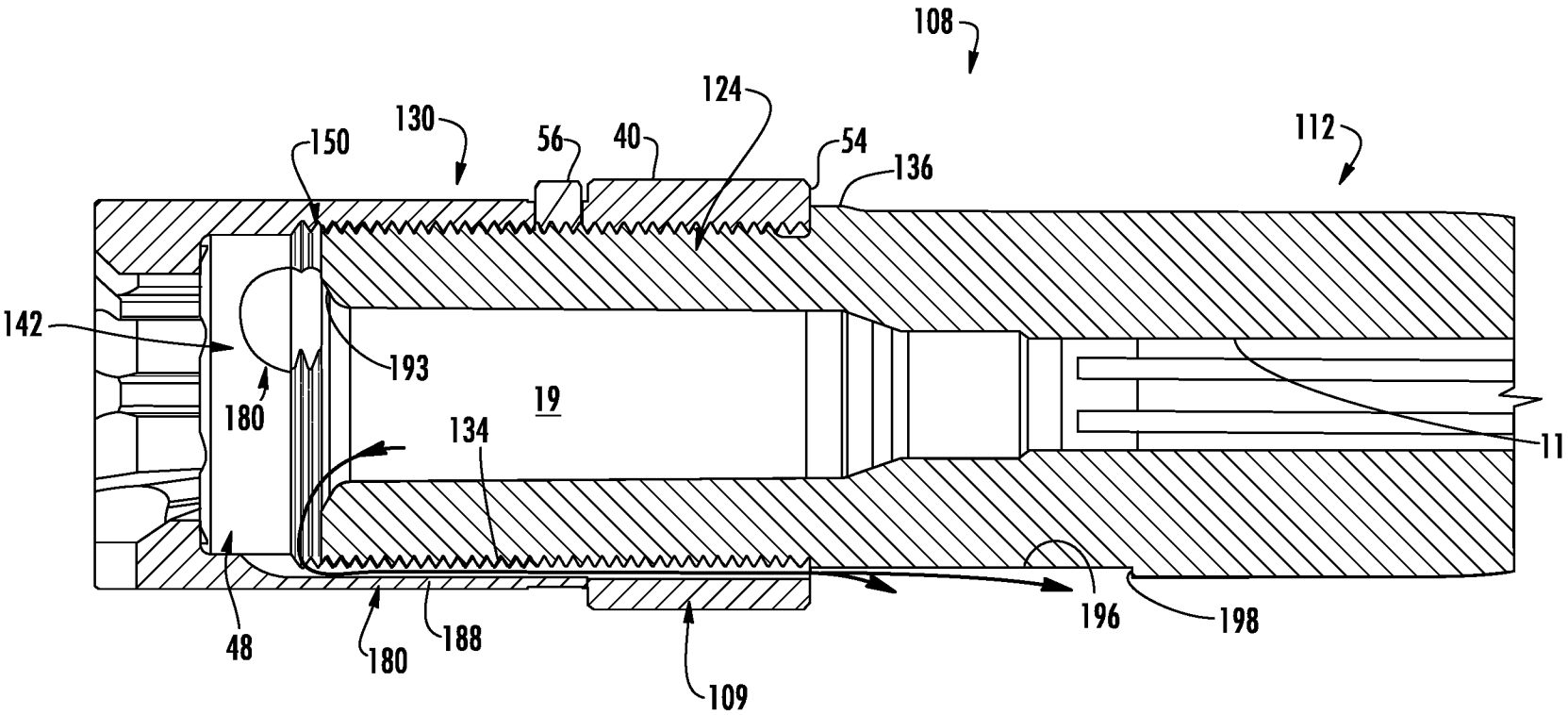
FIG. 11 is cross-sectional view of the assembled barrel and barrel extension of FIGS. 8A and 8B.

When the barrel extension 130 is assembled on the proximal end 124 of the barrel 112 and the channels 180 are aligned with respective reliefs 196 as shown in FIGS. 8A and 11, the channels 180 and the reliefs cooperate to provide respective fluid passageways extending from the breech end 193 of the chamber 19 in the proximal end 124 of the barrel 112 through the shoulder 136 in the barrel 112. Accordingly, in the event of an undesired buildup of pressurized gases in the chamber (e.g., due to a failure of a cartridge in the chamber 19), gases can escape from the chamber 19, passing from the breech end 193 of the barrel 112, through one or more of the channels 180, and through the reliefs 196 to escape the barrel mounting system 108 away from the shooter in a similar manner as described in the first embodiment above.

In an alternative embodiment, the barrel extension 130 could be omitted, and the receiver bore could be internally threaded for engaging the external threads 134 of the proximal end 124 of the barrel 112 or the threads 34 of the proximal end 24 of the barrel 12. In such an embodiment, the channels of the gas vent feature could be formed in the interior surface of the receiver bore, extending through the threads in a similar manner as in the channels 180 in the barrel extension 130 in the second embodiment.

It further will be understood that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular limns "a," "an," and "the" include plural references unless the context clearly dictates otherwise.

Unless defined otherwise, all technical and scientific terms used herein have the same meanings as commonly understood by one of ordinary skill in the art in the field to which this invention is directed, and it will be understood that any methods and materials similar or equivalent to those described herein can be used in the practice or construction of the invention.

Still further, the corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed is:

1. A barrel for a firearm, comprising:

a body having a proximal end adapted to engage a receiver of the firearm and including a chamber configured to receive a round of ammunition, wherein the proximal end comprises a series of threads configured for matingly engaging a threaded portion of a barrel extension or a barrel nut to connect the barrel to the barrel extension or a receiver of the firearm;

a central bore extending through the body of the barrel and along a longitudinal axis of the barrel from the chamber to a muzzle end of the barrel; and a gas vent in communication with the chamber and positioned along an exterior surface of the body of the barrel, the gas vent configured to vent excess high pressure gases generated by firing of the round of ammunition from the chamber, and comprising at least one channel formed in the exterior surface of the body of the barrel, wherein the at least one channel has an opening adjacent a breech end of the chamber and a predetermined depth below the exterior surface of the barrel, wherein the at least one channel extends forwardly in a direction generally parallel to the longitudinal axis of the barrel at least partially along the proximal end of the barrel so as to direct the gases forwardly and away from the receiver of the firearm, and wherein the at least one channel extends at least partially through one or more of the series of threads.

2. The barrel of claim 1, wherein the gas vent further comprises a plurality of channels formed in the exterior surface of the body of the barrel and arranged in substantially equally spaced relationship.

3. The barrel of claim 1, wherein the body of the barrel comprises a shoulder, and the shoulder is configured to engage or abut against at least a portion of a barrel nut, a barrel extension, and/or a receiver of the firearm.

4. The barrel of claim 1, wherein the shoulder is located along the proximal end, and with the barrel extension connected to the barrel, at least a portion of the barrel extension abuts a surface of the shoulder.

5. The barrel of claim 4, wherein the barrel extension comprises a plurality of locking lugs extending radially into an axial bore of the barrel extension, and wherein the plurality of locking lugs of the barrel extension are configured to at least partially align with a plurality of corresponding lugs of a bolt assembly of the firearm to lock the bolt assembly to the barrel extension.

6. The barrel of claim 1, wherein the at least one channel comprises a forward end configured to diffuse gases exiting the at least one channel.

7. The barrel of claim 1, wherein the depth of the at least one channel gradually decreases along a length thereof from the opening adjacent the breech end of the chamber to a depth approximately aligned with the exterior surface of the barrel.

8. A barrel mounting system for a firearm, comprising:

a barrel including a bore extending along a longitudinal axis defined therethrough, and a proximal end having a chamber that receives a round of ammunition for firing;

a barrel extension including a body defining an axial bore, wherein the barrel is at least partially received within the axial bore of the barrel extension at a distal end of the barrel extension, and the barrel extension is configured to be fixedly coupled to a receiver of the firearm at a proximal end of the barrel extension; and a gas vent arranged along an exterior surface of the barrel or along an interior surface of the barrel extension, the gas vent extending forwardly from a breech end of the chamber and configured to at least partially receive and vent excess high pressure combustion gases generated by the firing of the round of ammunition from the chamber, outwardly and away from the receiver of the firearm, wherein the barrel comprises external threads defined along the exterior surface at the proximal end of the barrel and the barrel extension comprises internal threads defined at least partially along the axial bore, and the external threads of the barrel and the internal threads of the barrel extension engage with one another to at least partially couple the barrel extension to the barrel, and wherein the gas vent comprises at least one channel extending at least partially through the internal threads of the barrel extension.

9. The barrel mounting system of claim 8, wherein the gas vent comprises one or more channels formed in the exterior surface of the barrel.

10. The barrel mounting system of claim 9, wherein the barrel further comprises a shoulder located along the exterior surface thereof, and the one or more channels extend at least partially into a portion of the shoulder.

11. The barrel mounting system of claim 10, wherein a relief is formed in the portion of the shoulder such that at least one channel extends through the shoulder.

12. The barrel mounting system of claim 8, wherein the gas vent comprises a plurality of channels spaced about a circumference of the barrel, and wherein each channel of the plurality of channels has a depth that increases toward a forward end thereof.

13. The barrel mounting system of claim 8, wherein the gas vent comprises a plurality of channels spaced along a circumference of the axial bore of the barrel extension.

14. A barrel mounting system for a firearm, comprising:

a barrel including a bore extending along a longitudinal axis defined therethrough, and a proximal end having a chamber that receives a round of ammunition for firing, wherein the barrel further comprises external threads along the proximal end thereof;

a barrel extension including a body defining an axial bore, wherein the barrel is at least partially received within the axial bore of the barrel extension at a distal end of the barrel extension, and the barrel extension is configured to be fixedly coupled to a receiver of the firearm at a proximal end of the barrel extension; and a gas vent arranged along an exterior surface of the barrel or along an interior surface of the barrel extension, the gas vent extending forwardly from a breech end of the chamber and configured to at least partially receive and vent excess high pressure combustion gases generated by the firing of the round of ammunition from the chamber, outwardly and away from the receiver of the firearm, wherein the gas vent comprises at least one channel extending at least partially through the external threads of the barrel.

15. A firearm, comprising:

a receiver;

a barrel mountable to the receiver in a substantially sealed engagement therewith and including a chamber that receives a round of ammunition;

a fire control comprising a trigger, a bolt assembly translatable about the receiver to load rounds of ammunition into the chamber, and a firing pin moveable upon activation of the trigger to fire the round of ammunition from the firearm;

a series of gas vents each extending along an exterior surface of the barrel, wherein each of the gas vents are configured with an open end adjacent the chamber and have a depth sufficient to enable high pressure combustion gases generated from firing of the round of ammunition and which are at least partially blocked from passage along the barrel to be vented from the chamber outwardly and away from the barrel; and a barrel extension having a body defining an axial bore, wherein a proximal end of the barrel is received at least partially through the axial bore of the barrel extension, wherein the barrel extension is at least partially received within a receiver bore formed in the receiver, wherein the axial bore of the barrel extension comprises internal threads engaging an externally threaded portion of the proximal end of the barrel, and wherein one or more of the gas vents comprises a channel extending at least partially through the internal threads in the axial bore.

16. The firearm of claim 15, wherein the proximal end of the barrel comprises external threads configured to engage an internally threaded portion of the axial bore of the barrel extension.

17. The firearm of claim 15, wherein one or more of the series of gas vents comprises a channel extending from a rearward face of the barrel through a shoulder formed along the exterior surface of the barrel.

18. The firearm of claim 17, further comprising a barrel extension having a forward face, wherein the channel comprises a tapered forward end disposed forward of the forward face of the barrel extension.

19. The firearm of claim 15, wherein the barrel comprises a shoulder adjacent a forward face of the barrel extension, wherein one or more of the gas vents comprises a series of reliefs formed in the barrel through at least a portion of the shoulder, and wherein each of the series of reliefs generally are aligned with a corresponding gas vent such that the corresponding gas vent extends through the shoulder.

20. The firearm of claim 15, wherein the gas vents comprise a plurality of channels that are spaced about the exterior surface of the barrel.

21. The firearm of claim 15, further comprising a barrel nut that is threadedly engaged with the receiver, the barrel nut engaging a forward face of the barrel extension for at least partially retaining the barrel extension in the receiver bore.

* * * * *